US006788282B2

(12) United States Patent
Ito

(10) Patent No.: US 6,788,282 B2
(45) Date of Patent: Sep. 7, 2004

(54) DRIVING METHOD FOR ELECTRO-OPTICAL DEVICE, DRIVING CIRCUIT THEREFOR, ELECTRO-OPTICAL DEVICE, AND ELECTRONIC APPARATUS

(75) Inventor: Akihiko Ito, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 135 days.

(21) Appl. No.: 10/078,360

(22) Filed: Feb. 21, 2002

(65) Prior Publication Data

US 2003/0156128 A1 Aug. 21, 2003

(51) Int. Cl.[7] ..... G09G 3/36
(52) U.S. Cl. ..... 345/103; 345/690
(58) Field of Search ..... 345/87, 89, 90, 345/92–96, 98–103

(56) References Cited

U.S. PATENT DOCUMENTS 5,262,881 A * 11/1993 Kuwata et al. ..... 345/94
5,731,802 A * 3/1998 Aras et al. ..... 345/692
5,777,593 A * 7/1998 Kondoh ..... 345/97
6,229,515 B1 * 5/2001 Itoh et al. ..... 345/103
6,388,661 B1 * 5/2002 Richards ..... 345/204
6,611,246 B1 * 8/2003 Ito et al. ..... 345/94

* cited by examiner

*Primary Examiner*—Henry N. Tran
(74) *Attorney, Agent, or Firm*—Oliff & Berridge, PLC

(57) ABSTRACT

The present invention provides a system and method for driving an electro-optical device in order to reduce the data transfer rate in one subfield while suppressing display non-uniformity. The invention can include a pixel positioned corresponding to each intersection between a plurality of scanning lines and a plurality of data lines that are turned on or off in subfields, into which one field is divided. This is accomplished according to a weighting of gray scale data (dcba) indicating the gray scale level of that pixel, and the reference time of weighting for the gray scale data is shifted every scanning line and every subfield. Accordingly, display nonuniformity resulting from unevenness in circuit characteristics, various wiring resistances and the like, can be reduced.

6 Claims, 19 Drawing Sheets

TIMING BETWEEN SELECTION OF SCANNING LINES IN EACH SUBFIELD AND WEIGHTING

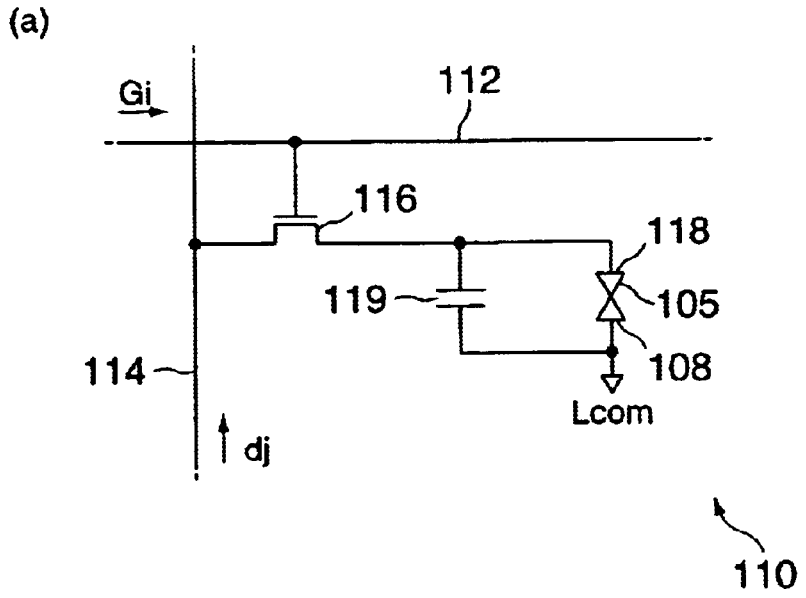
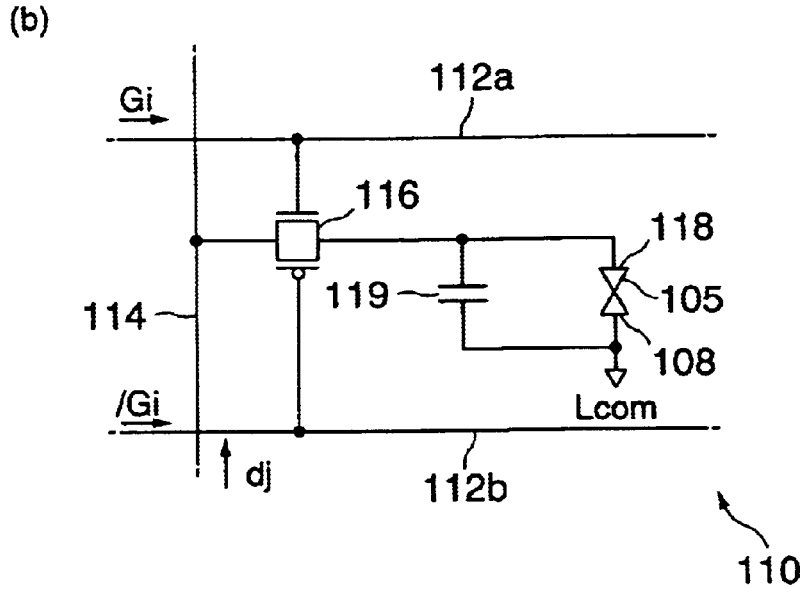
FIG. 2

TIMING BETWEEN SELECTION OF SCANNING LINES IN EACH SUBFIELD AND WEIGHTING

| | 1f | | | | | | | | | | | | | | | | |
|---|---|---|---|---|---|---|---|---|---|---|---|---|---|---|---|---|---|
| | sf1 | sf2 | sf3 | sf4 | sf5 | sf6 | sf7 | sf8 | sf9 | sf10 | sf11 | sf12 | sf13 | sf14 | sf15 | sf16 | sf17 |
| 1L | H1 h | | a | b | | c | | | | d | | | | | | | |
| 2L | | a | b | | c | | | | d | | | | | | | | h |
| 3L | H2 a | b | | c | | | | d | | | | | | | | h | |
| 4L | H3 b | | c | | | | d | | | | | | | | h | | a |
| 5L | | c | | | | d | | | | | | | | h | | a | b |
| 6L | H4 c | | | | d | | | | | | | | h | | a | b | |
| 7L | | | | d | | | | | | | | h | | a | b | | c |
| 8L | | | d | | | | | | | | h | | a | b | | c | |
| 9L | | d | | | | | | | | h | | a | b | | c | | |
| 10L | H5 d | | | | | | | | h | | a | b | | c | | | |
| 11L | | | | | | | | h | | a | b | | c | | | | d |
| 12L | | | | | | | h | | a | b | | c | | | | d | |
| 13L | | | | | | h | | a | b | | c | | | | d | | |
| 14L | | | | | h | | a | b | | c | | | | d | | | |
| 15L | | | | h | | a | b | | c | | | | d | | | | |
| 16L | | | h | | a | b | | c | | | | d | | | | | |
| 17L | | h | | a | b | | c | | | | d | | | | | | |
| 18L | H6 h | | a | b | | c | | | | d | | | | | | | |
| 19L | | a | b | | c | | | | d | | | | | | | | h |
| 20L | H7 a | b | | c | | | | d | | | | | | | | h | |
| 21L | H8 b | | c | | | | d | | | | | | | | h | | a |
| 22L | | c | | | | d | | | | | | | | h | | a | b |
| 23L | H9 c | | | | d | | | | | | | | h | | a | b | |
| 24L | | | | d | | | | | | | | h | | a | b | | c |
| 25L | | | d | | | | | | | | h | | a | b | | c | |
| ⋮ | | | | | | | | | | | | | | | | | |
| 230L | H70 | d | | | | | | | | h | | a | b | | c | | |
| 231L | d | | | | | | | | h | | a | b | | c | | | |
| 232L | | | | | | | | h | | a | b | | c | | | | d |
| 233L | | | | | | | h | | a | b | | c | | | | d | |
| 234L | | | | | | h | | a | b | | c | | | | d | | |
| 235L | | | | | h | | a | b | | c | | | | d | | | |
| 236L | | | | h | | a | b | | c | | | | d | | | | |
| 237L | | | h | | a | b | | c | | | | d | | | | | |
| 238L | | h | | a | b | | c | | | | d | | | | | | |
| 239L | H71 h | | a | b | | c | | | | d | | | | | | | |
| 240L | H72 a | H73 b | | H74 c | | | | H75 d | | | | | | | | H76 h | |

FIG.8

TIMING BETWEEN SELECTION OF SCANNING LINES IN EACH SUBFIELD AND WEIGHTING

DRIVING METHOD FOR ELECTRO-OPTICAL DEVICE, DRIVING CIRCUIT THEREFOR, ELECTRO-OPTICAL DEVICE, AND ELECTRONIC APPARATUS

BACKGROUND OF THE INVENTION

1. Field of Invention

The present invention relates to a driving method for an electro-optical device, in which gray scale display is performed by temporal modulation, a driving circuit therefor, an electro-optical device, and electronic apparatus.

2. Description of Related Art

Electro-optical devices, such as liquid crystal display devices that use liquid crystal as an electro-optical material, have been widely used. Most commonly, electro-optical devices are used as an alternative display devices to cathode-ray tubes (CRTs), as display units of various kinds of information processing apparatuses, such as liquid crystal television sets, and the like.

Conventional electro-optical device can be formed of, for example, an element substrate incorporating pixel electrodes which are arranged into a matrix, switching elements coupled with the pixel electrodes, etc., an opposing substrate having counter electrodes formed thereon which face the pixel electrodes, and liquid crystal as an electro-optical material which is filled between the two substrates. In such a structure, when a single scanning line is selected, the switching elements become conductive. As an image signal having a voltage corresponding to a gray scale level is applied to the pixel electrodes via a data line while they are conductive, an electric charge corresponding to the voltage of the image signal is stored in the liquid crystal layer between the pixel electrodes and the counter electrodes. After the electric charge has been stored, the electric charge stored in the liquid crystal layer is maintained due to a capacitive property of the liquid crystal layer itself, a storage capacitance, and the like, even if the switching elements are turned off. Accordingly, when the switching elements are driven to control the amount of electric charge to be stored according to the gray scale level, the orientation of the liquid crystal changes at each pixel. This causes the density to change for each pixel, thereby achieving gray scale display.

In this regard, the electric charge need only be stored in the liquid crystal layer of each pixel for some period of time, and the structure which involves, first, sequentially selecting scanning lines, and, second, for a pixel intersecting the selected scanning line, applying an image signal having a voltage corresponding to the gray scale level of that pixel to the corresponding data line allows for time-division multiplexing which allows a scanning line and a data line to be commonly used for a plurality of pixels.

However, the image signal to be applied to a data line has a voltage corresponding to the gray scale level of a pixel, that is, an analog signal. This requires a D/A converting circuit, an op amp, etc., as peripheral circuits of the electro-optical device, leading to increased cost of the overall device. In addition, display nonuniformity is caused by unevenness in characteristics of the D/A converting circuit, the op amp, etc., in various wiring resistances, etc., leading to a problem in that it is extremely difficult to perform high-quality display. This is particularly significant for high-definition display.

There are also problems of increased power consumption resulting from the D/A converting circuit, op amp, etc.

SUMMARY OF THE INVENTION

The present invention has been made in view of the foregoing situation, and it is an object thereof to provide an electro-optical device capable of high-quality and high-definition gray scale display and reduced power consumption, a driving method therefor, and a driving circuit therefor, and further, to provide electronic apparatus incorporating the electro-optical device.

In order to achieve the above object, the present invention can include a pixel which is arranged corresponding to each intersection between a plurality of scanning lines and a plurality of data lines. The pixel can be turned on or off by the subfield, which is the unit obtained by dividing one field into subfields, according to weighting of gray scale data indicating the gray scale level of the pixel. Further, a reference time of weighting for the gray scale data can be shifted every scanning line and every subfield.

According to the invention, the period when a pixel is turned on or off in one field is subjected to temporal modulation (also called pulse width modulation) according to gray scale data indicating the gray scale level of that pixel, with the result that it is displayed in gray scale under effective value control. In this regard, a pixel is merely turned on or off in each subfield, and thus only required is data (that is, a digital signal that can only take low or high level) for an instruction signal to the pixel, thereby eliminating a processing circuit for analog signals. According to the first invention, therefore, there is no need for a D/A converting circuit, an op amp or the like, and, in addition, it is possible to suppress display nonuniformity resulting from unevenness in characteristic of these circuit elements or in various wiring resistances, etc. The power consumption can further be reduced.

According to the first invention, furthermore, a reference time of weighting for gray scale data is shifted every scanning line and every subfield, and it is not necessary to sequentially select all scanning lines in each subfield, but it is sufficient to select only the scanning line in which the reference time of weighting has arrived. This makes it possible to reduce the data transfer rate in one subfield.

As used herein, the reference time of weighting for gray scale data indicates, as shown in FIG. 7, when one field 1f is divided into subfields sf1 to sf17 and when allocated to each bit of gray scale data indicating the gray scale level of a pixel is a subfield number corresponding to a pulse width period according to weighting of the gray scale level indicated by that bit, for example, a timing of the start of each allocated period. Herein, when the gray scale level of a pixel is indicated, binary gray scale data is always used for the indication, however, that gray scale data and the actual displayed gray scale level may not be sometimes in a one-to-one relation (for example, even if gray scale data has four bits, only eight-gray scale level display may be possibly performed by ignoring particular bits). Alternatively, as described below with respect to the mode for carrying out the invention, a subfield may be sometimes allocated to correction bit h other than the gray scale data. Thus, it is just expressed herein as a reference time of weighting for gray scale data.

Furthermore, in the present invention, one field can mean the time period required to form a single raster image by performing horizontally and vertically scanning in synchronization with horizontal scan signals and vertical scan signals. Therefore, one frame according to the non-interlace method, etc., also corresponds to one field according to the present invention.

According to the invention, the order in which scanning lines are selected differs from one subfield to another, and the period when a pixel is turned on or off may also occasionally differ from one scanning line to another if scanning line in which the reference time of weighting has arrived is simply selected in order. According to the invention, therefore, preferably, while scanning line in which the reference time of weighting has arrived is selected in a predetermined order, selection of a single scanning line in a particular subfield and selection of the scanning line adjacent thereto in the next subfield are performed in the identically numbered horizontal scan period. This way can make the period when a pixel is turned on or off uniform in (pixels positioned on) each scanning line.

Making the on- or off-period uniform in this way may also be possible in the manner that every predetermined number of scanning lines are grouped into a block, each of the blocks are selected in a predetermined order in each subfield, and the scanning line in which the reference time of weighting has arrived is selected in a predetermined order within a selected block, while selection of a single scanning line in a particular subfield and selection of the scanning line adjacent thereto in the next subfield are performed in the identically numbered horizontal scan period.

Next, in order to achieve the above object, the invention can include a driving circuit for an electro-optical device, wherein a pixel which is arranged corresponding to each intersection between a plurality of scanning lines and a plurality of data lines is turned on or off by the subfield, which is the unit obtained by dividing one field into subfields, according to weighting of gray scale data indicating the gray scale level of the pixel, and a reference time of weighting for the gray scale data is shifted every scanning line and every subfield. The driving circuit can include a scanning line driving circuit for selecting the scanning line in which the reference time of weighting has arrived in a predetermined order in each subfield, and a data line driving circuit for supplying data to the pixel that intersects the scanning line selected by the scanning line driving circuit via the corresponding data line, the data indicating that the pixel is turned on or off. Again, the invention suppresses display nonuniformity resulting from unevenness to perform high-quality and high-definition gray scale display, and reduces the data transfer rate in one subfield.

In addition, in order to achieve the above object, the present invention can include an electro-optical device in which a pixel includes a switching element arranged corresponding to each intersection between a plurality of scanning lines and a plurality of data lines and a pixel electrode connected to the switching element, the pixel being turned on or off by the subfield, which is the unit obtained by dividing one field into subfields, according to weighting of gray scale data indicating the gray scale level of the pixel, and a reference time of weighting for the gray scale data is shifted every scanning line and every subfield. Also, the electro-optical device can include a scanning line driving circuit for selecting the scanning line in which the reference time of weighting has arrived in a predetermined order in each subfield, and a data line driving circuit for supplying data to the pixel that intersects the scanning line selected by the scanning line driving circuit via the corresponding data line, the data indicating that the pixel is turned on or off. Again, the invention suppresses display nonuniformity resulting from unevenness to perform high-quality and high-definition gray scale display, and reduces the data transfer rate in one subfield.

In the invention, when a DC component is applied to an electro-optical material interposed between a pixel electrode and a counter electrode, the electro-optical material may be occasionally deteriorated, so that the structure in which the voltage level to be applied to the counter electrode is inverted at intervals of a predetermined period and the voltage of data indicating that the pixel is turned on or off is inverted according to this inversion with reference to the voltage level applied to the counter electrode. Alternatively, the structure in which the voltage level applied to the counter electrode is constant and the voltage of data indicating that the pixel is turned on or off is inverted at intervals of a predetermined period with reference to the voltage level applied to the counter electrode is preferable.

Furthermore, in order to achieve the above object, the embodiments of the present invention can include the above-described electro-optical device, thereby making it possible to suppress display nonuniformity resulting from unevenness to achieve high-quality and high-definition gray scale display, and to reduce the data transfer rate in one subfield.

BRIEF DESCRIPTION OF THE DRAWINGS

The invention will be described with reference to the accompanying drawings, in which like elements are referred to with like numerals, and in which:

FIG. 2 shows circuit diagrams each showing an example structure of a pixel in the same electro-optical device;

FIG. 8 is a view showing a relationship between selection of each scanning line and the reference time of weighting for each subfield in the same electro-optical device;

DETAILED DESCRIPTION OF PREFERRED EMBODIMENTS

Figure 5:
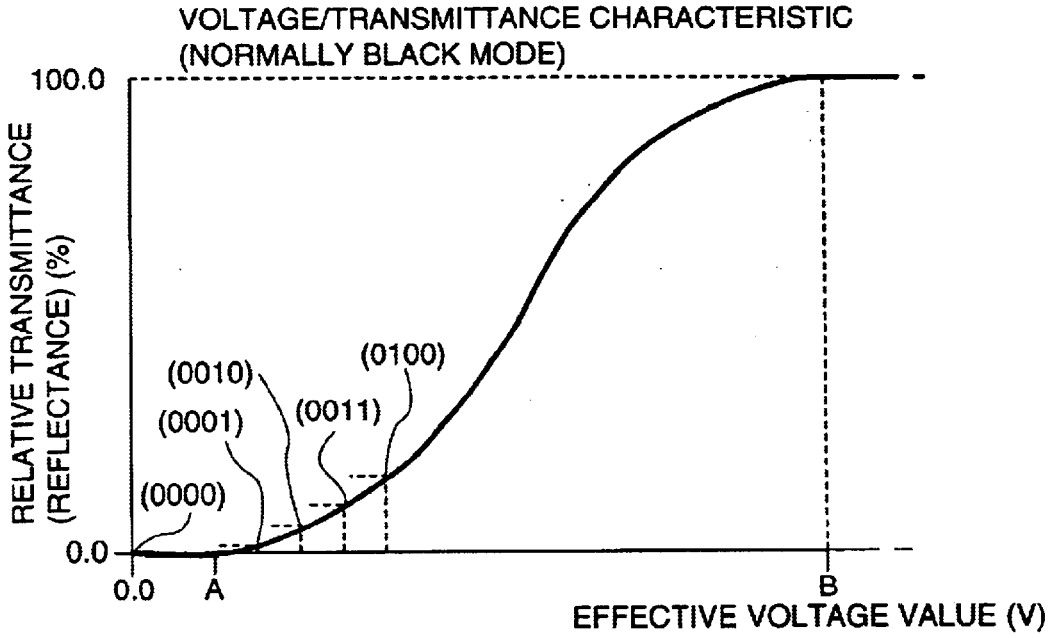
FIG. 5 is a view showing a relationship between effective voltage value applied to a liquid crystal layer in the same electro-optical device, and transmittance.

Before an electro-optical device according to an embodiment of the present invention is described, first, the theoretical assumptions of gray scale display according to the present invention are briefly described. In general, in a liquid crystal device using liquid crystal as an electro-optical material, the relationship between an effective voltage value applied to the liquid crystal layer forming a pixel (when the applied on voltage is constant and the pulse width of the on voltage is changed) and the relative transmittance (or reflectance) is as shown in FIG. 5, if a normally black mode is taken as an example where black display is performed while no voltage is applied. Specifically, the relationship is that the transmittance (or reflectance) varies as the effective voltage value applied to the liquid crystal layer ranges from A (V) to B (V). The relative transmittance, as used herein, is determined by normalizing the minimum and maximum values of the amount of transmission light as 0% and 100%, respectively.

It is assumed that the electro-optical device according to the present embodiment provides 16-gray scale level display according to gray scale (intensity) data represented by four bits. In the past, a structure has been used in which an analog voltage corresponding to the gray scale data is applied to the liquid crystal layer via data lines. As described above, the the analog voltage is thus susceptible to the influence of the characteristics of analog circuits, such as the D/A converting circuit and op amp, or variations in various wiring resistances and the like, and the influence is likely to cause unevenness among pixels, thereby making it difficult to achieve high-quality and high-definition gray scale display.

Accordingly, first, the electro-optical device according to the present embodiment implements a signal to be applied to data lines as binary bit data, and this bit data is used for pulse-width control for the effective voltage value applied to the liquid crystal layer in a period of one field. That is, the structure is such that the instantaneous voltage which is applied to the liquid crystal layer is binary according to the bit data, and the effective voltage value applied to the liquid crystal layer in a period of one field is controlled according to the gray scale data, thereby achieving gray scale display.

Herein, gray scale data indicating a transmittance of 0% is expressed by (0000), followed by (0001), (0010), (0011), . . . , and (1111) in ascending order toward higher transmittance. In this regard, it is necessary to allocate different effective voltage values ranging from A (V) to B (V) to the 15 pieces of gray scale data apart from (0000) on a one-to-one basis. In the present embodiment, thus, the concept of a correction bit h is introduced in which "0" is allocated only to gray scale data (0000) and "1" is allocated otherwise.

Figure 6:
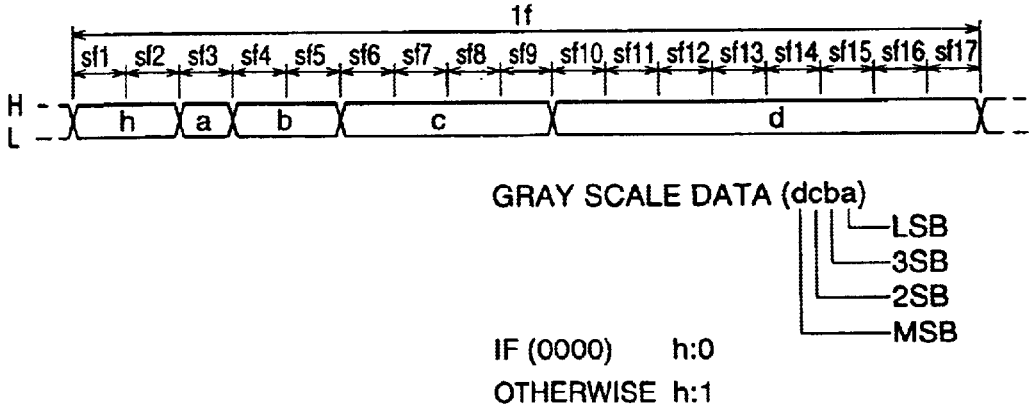
FIG. 6 is a view showing a relationship between gray scale data (dcba)/correction bit h, and a voltage applied in a subfield in the same electro-optical device.

Specifically, as shown in FIG. 6, one field (1f) is equally divided into 17 subfields sf1 to sf17, and the above-noted bit data is associated with the values of gray scale data (dcba) bits or the correction bit h so that application to the liquid crystal layer may be performed only in a period of the subfield based on its weight. This causes a voltage to be applied according to the weight of the correction bit h, if the gray scale data is other than (0000), to offset the voltage corresponding to A (V), and causes the voltage corresponding to the weight of the gray scale data to be added to the offset voltage A (V).

Thus, an effective voltage value of zero is associated with gray scale data (0000), and different effective voltage values ranging from A (V) to B (V) are associated with the 15 pieces of gray scale data apart from (0000) on a one-to-one basis, thereby achieving gray scale display corresponding to the gray scale data.

The gray scale data (dcba) represents a general notation, in which "a", "b", "c", and "d" indicate LSB, 3SB, 2SB, and MSB, respectively. In this example, the period of the subfield corresponding to the correction bit h is equal to "2", and the total number of subfields that constitute one field is "17" with $h:a:b:c:d=2:2^0:2^1:2^2:2^3$. However, the voltage corresponding to A (V) varies depending upon parameters, including the liquid crystal material, the gap between the substrates, and the temperature. In practice, the duration of the subfield corresponding to the correction bit h (and the total number of subfields that constitute one field) is defined in consideration of these parameters.

Meanwhile, with the structure in which scanning lines are selected one-by-one in each subfield into which one field is divided, while bit data is supplied to the pixels positioned on the selected scanning line via data lines, the transfer rate of the bit data may be extremely higher than that of the conventional structure in which an analog voltage corresponding to the gray scale level is supplied to each pixel in a period of one field. For example, the bit data corresponding to bit b of the gray scale data must be sequentially supplied to all pixels at the start of subfield sf4 in FIG. 6, and, for this reason, the transfer rate of the bit data must accordingly be higher than that of the conventional structure since one field is divided into subfields.

Figure 7:
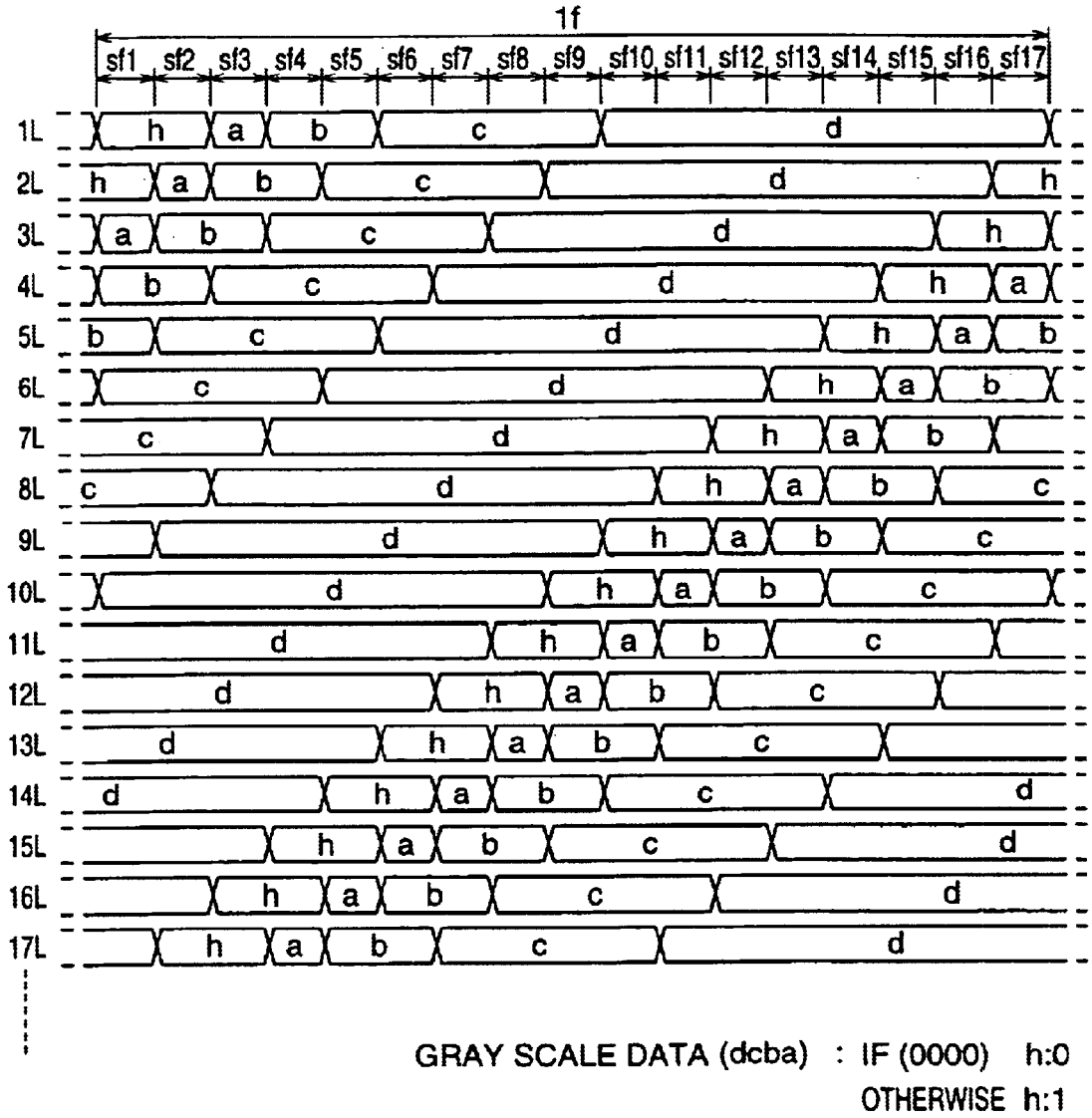
FIG. 7 is a view showing a relationship between gray scale data (dcba)/correction bit h applied to scanning lines in one field, and subfields.

Accordingly, secondly, the electro-optical device according to the present embodiment employs a structure in which bit data is supplied at the timing shown in FIG. 7 in one field. FIG. 7 illustrates bit data which is supplied in each subfield to pixels associated with first, second, third scanning lines . . . 1L, 2L, 3L, . . . , from the top. In this figure, from a reference time of weighting for bit data corresponding to a certain bit in the gray scale data to the next reference time, it is not necessary to rewrite that bit data, and it is sufficient to hold the bit data which has been written in the previous stage. As shown in FIG. 7, therefore, the reference time of weighting for bit data is shifted every scanning line and every subfield, thereby presenting, in a certain subfield, a scanning line which does not require rewriting. For example, referring to FIG. 7, in (at the start of) the subfield sf4, the first, third, seventh, fifteenth, seventeenth scanning lines, etc., from the top, are selected, and the pixels positioned on those scanning lines must be rewritten with bit data corresponding to the bits b, c, d, h, and a, respectively. However, the pixels positioned on the other scanning lines need not be rewritten. With such a structure, therefore, it is not necessary to select all scanning lines in each subfield, thereby reducing the transfer rate of the bit data.

Accordingly, with the structure in which binary bit data is applied to data lines and the reference time of weighting in one field is shifted by one subfield every scanning line, high-definition and high-quality image display can be performed while the transfer rate of bit data is lowered. The structure for this is now described with reference to the drawings.

To begin with, an electro-optical device according to an embodiment of the present invention is a liquid crystal device using liquid crystal as an electro-optical material. The device can include an element substrate and an opposing substrate, which are bonded with a predetermined spacing therebetween, as described below, and liquid crystal as the electro-optical material, which is held in the spacing. The electro-optical device according to the present embodiment further has a TFT (Thin Film Transistor) for driving a pixel, a peripheral driving circuit, etc., formed on the element substrate.

Figure 1:
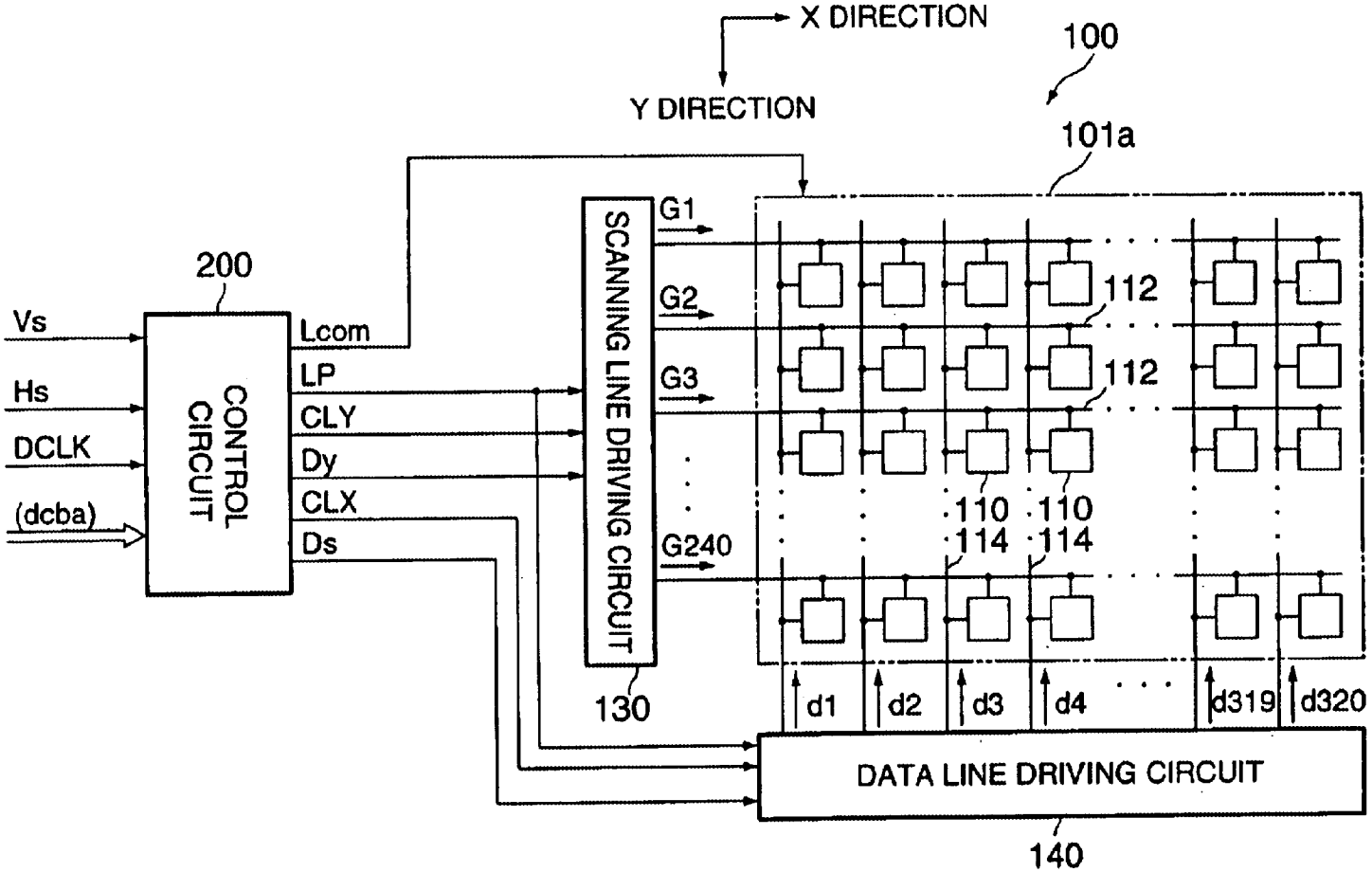
FIG. 1 is a block diagram of the electrical structure of an electro-optical device according to an embodiment of the present invention.

FIG. 1 is a block diagram of the electrical structure of the electro-optical device 100. In the figure, a control circuit 200 generates various signals, as described below, according to a vertical scan signal Vs, a horizontal scan signal Hs and a dot clock signal DCLK, and gray scale data (dcba) which are supplied from higher level devices (not shown).

Figure 9:
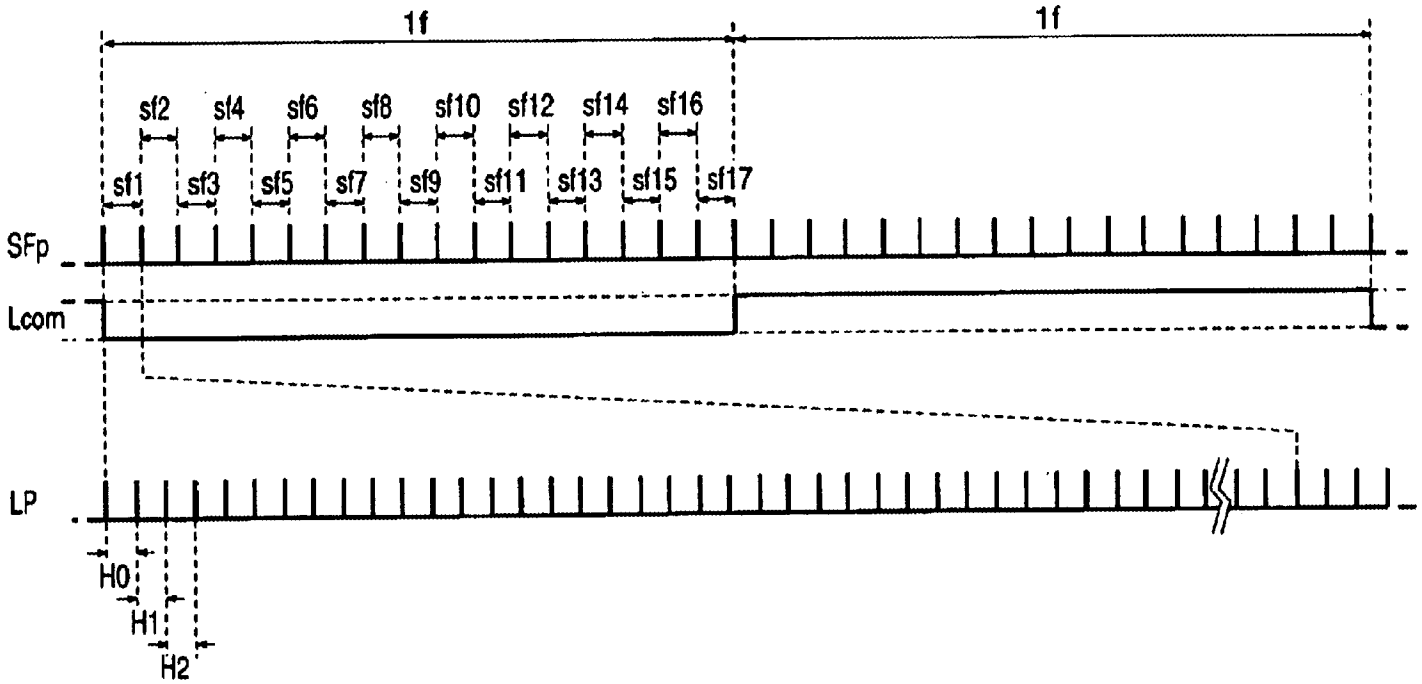
FIG. 9 is a timing chart for illustrating the operation of the same electro-optical device.

First, a signal Lcom is a signal which is level-inverted every one field (one frame) in the present embodiment, as shown in FIG. 9, and is applied to a counter electrode on the opposing substrate, as will be described below. A start pulse Sfp is a pulse signal which is output at the beginning of each of 17 subfields sf1 to sf17 into which one field 1f is equally divided, but the start pulse is used for internal processing (recognition of subfields, etc.) of the control circuit 200, and is not externally viewed.

Second, a latch pulse LP is a pulse signal which is output at the beginning of each of horizontal scan periods for the subfields sf1 to sf17, as shown in FIG. 9. For convenience of illustration, the output period of the latch pulse LP is expressed by 1H (i.e., one horizontal scan period), and the n-th single horizontal scan period is indicated by Hn. For example, "2H" can mean two horizontal scan periods corresponding to a double the output period of the latch pulse LP, although H2 can mean the second single horizontal scan period.

Third, a clock signal CLY is a signal for use in data transfer in a scanning line driving circuit 130 described below. Fourth, data Dy is data indicating a scanning line to be selected in each horizontal scan period for the subfields sf1 to sf17, and is supplied in synchronization with the clock signal CLY. The details thereof will be described below.

Fifth, a clock signal CLX is a signal for specifying a so-called dot clock, and is a signal for use in data transfer in a data driving circuit 140 described below.

Sixth, bit data Ds corresponds to the value of gray scale data (dcba) or correction bit h for a pixel positioned on a selected scanning line, and corresponds to the subfields at the time of selection, and is supplied in synchronization with the clock signal CLX. The details thereof will be described below.

On the other hand, a plurality of scanning lines 112 extending in the X (row) direction in the figure, and a plurality of data lines 114 extending in the Y (column) direction are formed on a display region 101*a* on the element substrate. A pixel 110 is positioned at each intersection between the scanning lines 112 and the data lines 114, and the pixels 110 are arranged into a matrix. For convenience of illustration, in the present embodiment, a 240 rows×320 columns matrix-type display device having a total of 240 scanning lines 112 and a total of 320 data lines 114 is described, however, the present invention is not intended to be limited thereto.

Next, a scanning line driving circuit 130 sequentially latches 240 pieces of data Dy corresponding to the number of scanning lines 112 in one given horizontal scan period, and then supplies the latched 240 pieces of data Dy to the corresponding scanning lines 112 all at once in the next horizontal scan period as scan signals G1, G2, G3, . . . , and G240, respectively.

Since only one scanning line 112 is selected in one horizontal scan period, only one of the 240 pieces of data Dy, which are latched in the same period, goes high.

A data line driving circuit 140 sequentially latches 320 pieces of bit data Ds corresponding to the number of data lines 114 in one given horizontal scan period, and then supplies the latched 320 pieces of bit data Ds to the corresponding data lines 114 all at once in the next horizontal scan period as data signals d1, d2, d3, . . . , and d320, respectively. The scanning line driving circuit 130 and the data line driving circuit 140 will be described below in detail.

The scanning line driving circuit 130, the data line driving circuit 140, the control circuit 200, etc., can be powered by a single power supply circuit (not shown) as the power source. Hence, high and low levels of signals output from these circuit elements match the high-level voltage Vdd and low-level voltage Vss (=GND) of the power supply circuit.

The detailed structure of the pixels 110 is now described. FIG. 2(*a*) is a circuit diagram showing an example of one pixel 110 in the electro-optical device. For the sake of generalized illustration, this figure shows a pixel 110 corresponding to an intersection between the i-th (i is an integer satisfying $1 \leqq i \leqq 240$) scanning line 112 from the top in FIG. 1 and the j-th (j is an integer satisfying $1 \leqq j \leqq 320$) data line 114 from the left.

As shown in this figure, the gate, source, and drain of the TFT 116 serving as a switching element are connected to the scanning line 112, the data line 114, and the pixel electrode 118, respectively, and the liquid crystal 105 as an electro-optical material is held between the pixel electrode 118 and the counter electrode 108, thereby forming a liquid crystal layer. Herein, in effect, the counter electrode 108 is a common electrode formed on the entirety of the opposing substrate so as to face the pixel electrode 118, as will be described below. The potential of the counter electrode 108 is level-inverted every field as the signal Lcom is applied, as previously described, in the electro-optical device according to the present embodiment. A storage capacitance 119 is formed between the drain of the TFT 116 (pixel electrode 118) and the capacitor electrode in parallel with the liquid crystal layer so as to prevent leakage of the electric charge stored in the liquid crystal layer. Preferably, the capacitor electrode uses a dedicated capacitor line, to which the signal Lcom is applied, as in the counter electrode 108.

In the structure shown in FIG. 2(*a*), only an n-channel TFT is used as the TFT 116, thereby requiring an offset voltage in order to prevent voltage drop from occurring in the liquid crystal due to the parasitic capacitance of the TFT. As shown in FIG. 2(*b*), on the other hand, a complementary combination of a p-channel TFT and an n-channel TFT can allow the influence of the offset voltage to be cancelled out. However, such a complementary construction requires mutually exclusive scan signal levels to be supplied, thus requiring two scanning lines 112*a* and 112*b* for 320 pixels 110 in one row.

The scanning line driving circuit 130 is now described. As described above, in the electro-optical device according to the present embodiment, as shown in FIG. 7, the reference time of weighting for bits of the gray scale data or the correction bit is shifted by one subfield every scanning line, thus requiring the scanning line 112 in which the reference time of weighting has arrived in each subfield to be selected one-by-one in a predetermined order. Therefore, the scanning line driving circuit 130 has the structure shown in FIG. 3.

Figure 3:
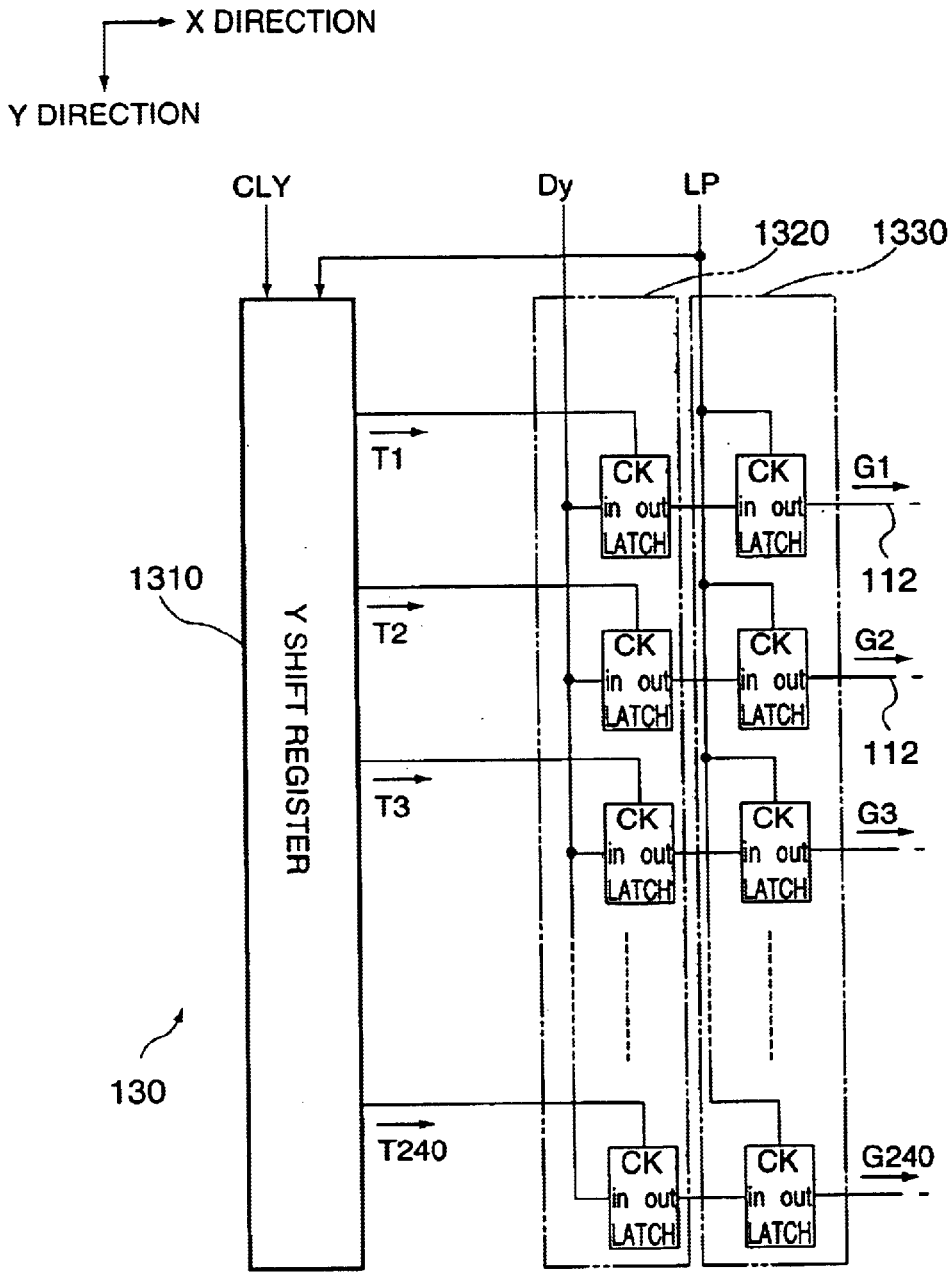
FIG. 3 is a block diagram of the structure of a scanning line driving circuit in the same electro-optical device.

More specifically, as shown in FIG. 3, the scanning line driving circuit 130 is formed of a Y shift register 1310, a first latch circuit 1320, and a second latch circuit 1330. Of these, the Y shift register 1310 transfers a latch pulse LP which is supplied at the beginning of each horizontal scan period according to the clock signal CLY, and sequentially supplies the latch pulse LP as latch signals T1, T2, T3, . . . , and T240. Next, the first latch circuit 1320 sequentially latches the data Dy when the latch signals T1, T2, T3, . . . , and T240 fall. The second latch circuit 1330 latches the individual data Dy which has been latched by the first latch circuit 1320 all at once when the latch pulse LP corresponding to the next horizontal scan period falls, and supplies it as scan signals G1, G2, G3, . . . , and G240 to the respective scanning lines 112. In the figure, although the data Dy is transmitted in one line, the data Dy may also be transmitted in a plurality of lines in a parallel manner, such that the data Dy in the plurality of lines are concurrently latched to the plurality of first latch circuits 1320 in response to the latch signal from the Y shift register 1310, thereby reducing the number of stages of the Y shift register 1310.

Since the gate voltage amplitude of the TFT 116, that is, the voltage amplitude of the scan signals G1, G2, G3, . . . , and G240 must be greater than the voltage amplitude (Vdd−Vss) of the data signal to be applied to the data lines 114, in practice, a level shifter for increasing the voltage amplitude is placed after the second latch circuit 1330 for each scanning line 112 (not shown in the figure). In the case of complementary TFTs 116 as shown in FIG. 2(*b*), the gate voltage amplitude can be equal to the voltage amplitude (Vdd−Vss) of the data signal, and a buffer for increasing the amount of a current flowing is thus placed after the second latch circuit 1330 for each scanning line 112 (not shown in the figure).

Selection of the scanning lines in the thus constructed scanning line driving circuit 130 is now described. The reference time of weighting that reaches the scanning lines 112 is as shown in FIG. 8 for each subfield. Specifically, FIG. 8 means that a scanning line on which any of the bits a, b, c, and d of the gray scale data and the correction bit h is written is selected in each subfield, and that bit data corresponding to the value of that bit must be written to the pixels positioned on that scanning line.

According to the present embodiment, therefore, in the control circuit 200, a scanning line to be selected in each subfield is placed into a table shown in FIG. 8, and the table is referenced so that the data Dy for selecting the scanning lines 112 is output. For example, as is seen with reference to FIG. 8, in the subfield sf1, the first scanning line 112 from the top is selected in the first horizontal scan period H1 for writing corresponding to the value of the correction bit h. Then, the third scanning line 112 from the top is selected in the second horizontal scan period H2 for writing corresponding to the bit a of the gray scale data. Subsequently, the fourth scanning line 112 from the top is selected in the third horizontal scan period H3 for writing corresponding to the bit b of the gray scale data.

Desirably, the table shown in FIG. 8, indicating the scanning lines to be selected, is stored in a memory, such as a ROM, so that the memory is sequentially addressed by a timing signal synchronized with the horizontal scan periods and subfields, and is read as data Dy.

In FIG. 8, the scanning lines 112 are selected in order from the top in each subfield, such that selection of a particular scanning line 112 in a particular subfield and selection of the one upper scanning line 112 in the next subfield are performed in the identically numbered horizontal scan period in the respective subfields. For example, selection of the third scanning line 112 from the top in the subfield sf1, selection of the second scanning line 112 from the top in the subfield sf2, and selection of the first scanning line 112 from the top in the subfield sf3 are all performed in a second horizontal scan period H2.

The detailed structure of the data line driving circuit 140 is now described with reference to FIG. 4. As shown in this figure, the data line driving circuit 140 has the same structure as the scanning line driving circuit 130 except that a different signal is supplied thereto. Specifically, as is common with the scanning line driving circuit 130, the data line driving circuit 140 is formed of an X shift register 1410, a first latch circuit 1420, and a second latch circuit 1430. Of these, the X shift register 1410 transfers the latch pulse LP which is supplied at the beginning of each horizontal scan period according to the clock signal CLX, and sequentially supplies it as latch signals S1, S2, S3, . . . , and S320. Then, the first latch circuit 1420 sequentially latches the bit data Ds when the latch signals S1, S2, S3, . . . , and S320 fall. The second latch circuit 1430 latches the individual bit data DS which has been latched by the first latch circuit 1420 all at once when the latch pulse LP falls, and supplies it as data signals d1, d2, d3, . . . , and d320 to the data lines 114. In the figure, although the bit data Ds is transmitted in one line, the bit data Ds may be transmitted in a plurality of lines in a parallel manner, such that the bit data Ds in the plurality of lines are concurrently latched to the plurality of first latch circuits 1420 in response to the latch signal from the X shift register 1410, thereby reducing the number of stages of the X shift register 1410.

Next, the relationship between the level of the data signals (bit data Ds) applied by the data line driving circuit 140 and the gray scale level s of the corresponding pixels is described. As described above, the reference time of weighting that reaches the scanning lines 112 in each subfield is as shown in FIG. 8. This means that a scanning line on which any of the bits a, b, c, and d of the gray scale data and the correction bit h is written is selected in each subfield and that bit data corresponding to the value of that bit is written to the pixel positioned on that scanning line. Therefore, the present embodiment provides a structure in which the bit data Ds of the pixels 110 of one row corresponding to the selected scanning line is output according to the contents shown in FIG. 8.

Here, since the signal Lcom applied to the counter electrode 108 is level-inverted every field, the potential thereof should be taken into account in order to determine the level of the bit data Ds. Specifically, in a field where the signal Lcom is low, the control circuit 200 forwards the bit of the pixel gray scale data (dcba) that corresponds to the subfield and the selected scanning line (or the correction bit) as is to output the high level as the bit data Ds, while, in a field where the signal Lcom is high, it inverts the level of the corresponding bit of the pixel gray scale data (dcba) (or correction bit) to be output as the bit data Ds.

In the present embodiment, "1" in the gray scale bits or correction bit corresponds to the high level of the bit data Ds, and "0" in the gray scale bits or correction bit corresponds to the low level of the bit data Ds.

The control circuit 200 must also recognize which subfield in one field it is, and which horizontal scan period in one subfield it is in order to output the data Dy and the bit data Ds. These can be recognized by counting the start pulse Sfp or the latch pulse LP, and by referring to the counting result.

Figure 10:
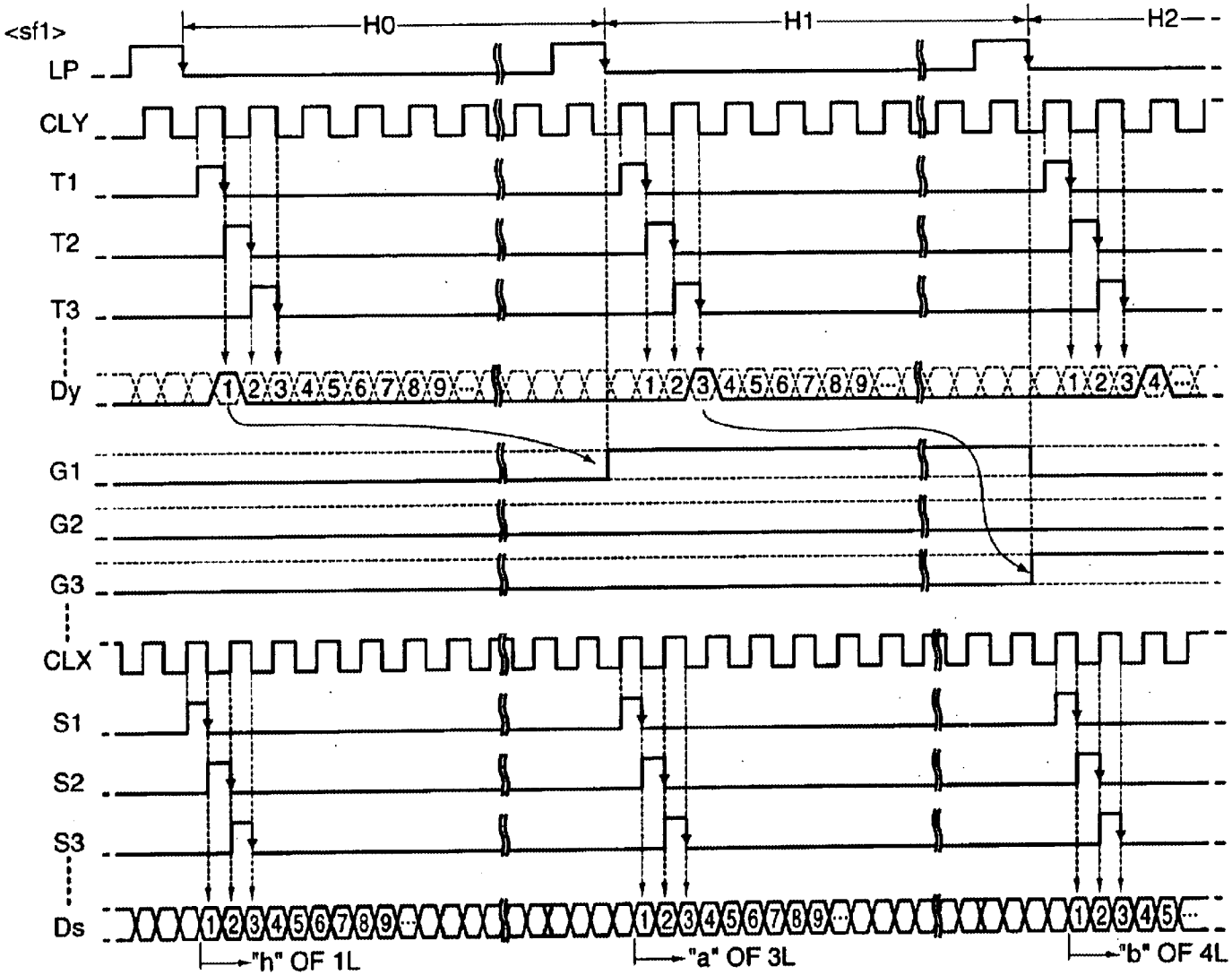
FIG. 10 is a timing chart for illustrating the operation of the same electro-optical device.

The operation of the electro-optical device according to the above-described embodiment is now described. FIGS. 9 and 10 are timing charts for illustrating the operation of the electro-optical device.

Initially, as shown in FIG. 9, the signal Lcom is level-inverted every one field (1f), and is applied to the counter electrode 108. Here, when the latch pulse signal LP is supplied at the beginning of the subfield sf1 in one field (1f) where the signal Lcom is low, as shown in FIG. 10, latch signals T1, T2, T3, . . . , and T240 are sequentially output in the scanning line driving circuit 130 (see FIGS. 1 and 3) through the transfer according to the clock signal CLY in the 0th single horizontal scanning line period H0. Each of the latch signals TI, T2, T3, . . . , and T240 has a pulse width corresponding to a half period of the clock signal CLY.

Here, referring to FIG. 8, it is the first scanning line 112 from the top that is to be selected in the first single horizontal scan period H1 in the subfield sf1. Thus, the control circuit 200 outputs the data Dy which goes high only when the latch signal T1 falls, while the first latch circuit 1320 in FIG. 3 latches the high-level data Dy when the latch signal T1 falls, and latches the low-level data Dy when each of the subsequent latch signals T2, T3, . . . , and T240 falls.

Thus, the first latch circuit 1320 sequentially latches the data Dy in the 0th horizontal scan period indicating that only the first scanning line 112 from the top is selected while the other scanning lines 112 are not selected. It is needless to say that the control circuit 200 outputs the data Dy in synchronization with the latch timing of the first latch circuit 1320.

On the other hand, in the data line driving circuit 140 (see FIGS. 1 and 4), when the latch pulse signal LP is supplied at the beginning of the subfield sf1, as shown in FIG. 10, the latch signals S1, S2, S3, . . . , and S320 are sequentially output through the transfer according to the clock signal CLX in the 0th single horizontal scan period H0. Each of the latch signals S1, S2, S3, . . . , and S320 has a pulse width corresponding to a half period of the clock signal CLX.

Figure 4:
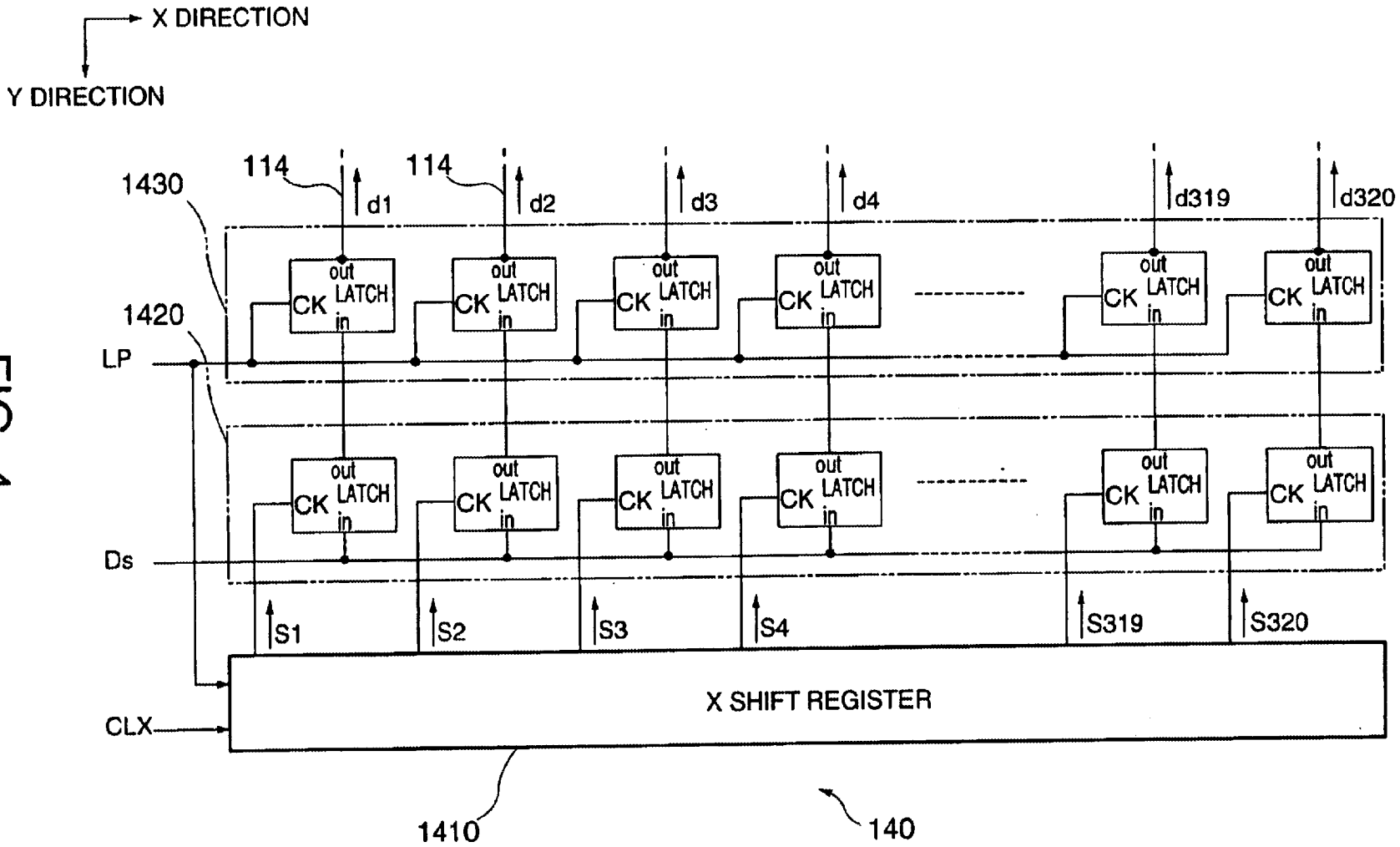
FIG. 4 is a bock diagram of the structure of a data line driving circuit in the same electro-optical device.

In this regard, the first latch circuit 1420 in FIG. 4 latches the bit data Ds to the pixel 110 corresponding to an intersection between the first scanning line 112 from the top and the first data line 114 from the left when the latch signal S1 falls, then, latches the bit data Ds to the pixel 110 corresponding to an intersection between the first scanning line 112 from the top and the second data line 114 from the left when the latch signal S2 fall, and so does it subsequently in the same manner, latching the bit data Ds to the pixel 110 corresponding to an intersection between the first scanning line 112 from the top and the 320th data line 114 from the left. The bit data Ds output in this period corresponds to the value of the correction bit h.

Therefore, in the data line driving circuit 140, first latch circuit 1420 sequentially latches the bit data Ds of pixels of one row corresponding to intersections with respect to the first scanning line 112 from the top. It is needless to say that the control circuit 200 determines gray scale data (dcba) of each pixel to generate a correction bit h, and outputs it in synchronization with the latch timing of the first latch circuit 1420. Herein, the case where the signal Lcom is low is assumed, and the correction bit h and the bit data Ds are in a forward relation.

Subsequently, when the latch pulse LP is output again and then falls, proceeding to the first horizontal scan period H1, the second latch circuit 1330 of the scanning line driving circuit 130 applies the sequentially latched data Dy to the corresponding scanning lines 112 all at once as scan signals G1, G2, G3, . . . , and G240 at the timing when it falls. Since only the scan signal G1 is high, only the first scanning line 112 from the top is selected, thereby causing all of the TFTs 116 of the pixels 110 corresponding to intersections with respect to that scanning line 112 to be turned on.

In parallel to the output of these scan signals, in the scanning line driving circuit 130, the first latch circuit 1320 sequentially latches the data Dy for selecting only the third scanning line 112 from the top in the same manner.

On the other hand, in the data line driving circuit 140, when the re-output latch pulse LP falls, the second latch circuit 1430 supplies the sequentially latched bit data Ds to the corresponding data lines 114 as data signals d1, d2, d3, . . . , and d320 all at once at the timing when it falls. This causes the data signals d1, d2, d3, . . . , and dn to be written all at once to the pixels 110 of one row from the top.

In parallel to the writing, in the data line driving circuit 140, the first latch circuit 1420 sequentially latches the bit data Ds which is bit data of the pixels of one row corresponding to intersections with respect to the third scanning line 112 from the top and which corresponds to the value of bit a of the gray scale data (dcba).

In the subfield sf1, the same operation is repeated until a scan signal G239 corresponding to the 239th scanning line 112 from the top is output in the 71th horizontal scan period H71. That is, in a horizontal scan period when the data signals d1, d2, d3, . . . , and d320 are written to the pixels of one row corresponding to a particular scanning line 112, the data Dy indicating a scanning line 112 to be selected in the next horizontal scan period is sequentially latched in the scanning line driving circuit 130, while the bit data Ds of the pixels of one row corresponding to that scanning line is sequentially latched in the data line driving circuit 140. For the pixels 110 corresponding to the scanning lines 112 which are not selected, the data signals which were written in the previous stage are held until the next writing.

The same operation is subsequently repeated in each subfield. However, the control circuit 200 causes the data Dy indicating a scanning line 112 to be selected, and the bit data Ds of the pixels of one row corresponding to that scanning line 112 to be output one horizontal scan period prior to the table shown in FIG. 8 at each corresponding timing.

As one field has elapsed, when the signal Lcom is inverted to the high level, the same operation is also repeated in each subfield. However, the bits of gray scale data (dbca) or the correction bit h, and the bit data Ds corresponding thereto are in a reverse relation. The switching timing of the potential between the scan signals and the data signals may sometimes be shifted, as required.

Figure 11:
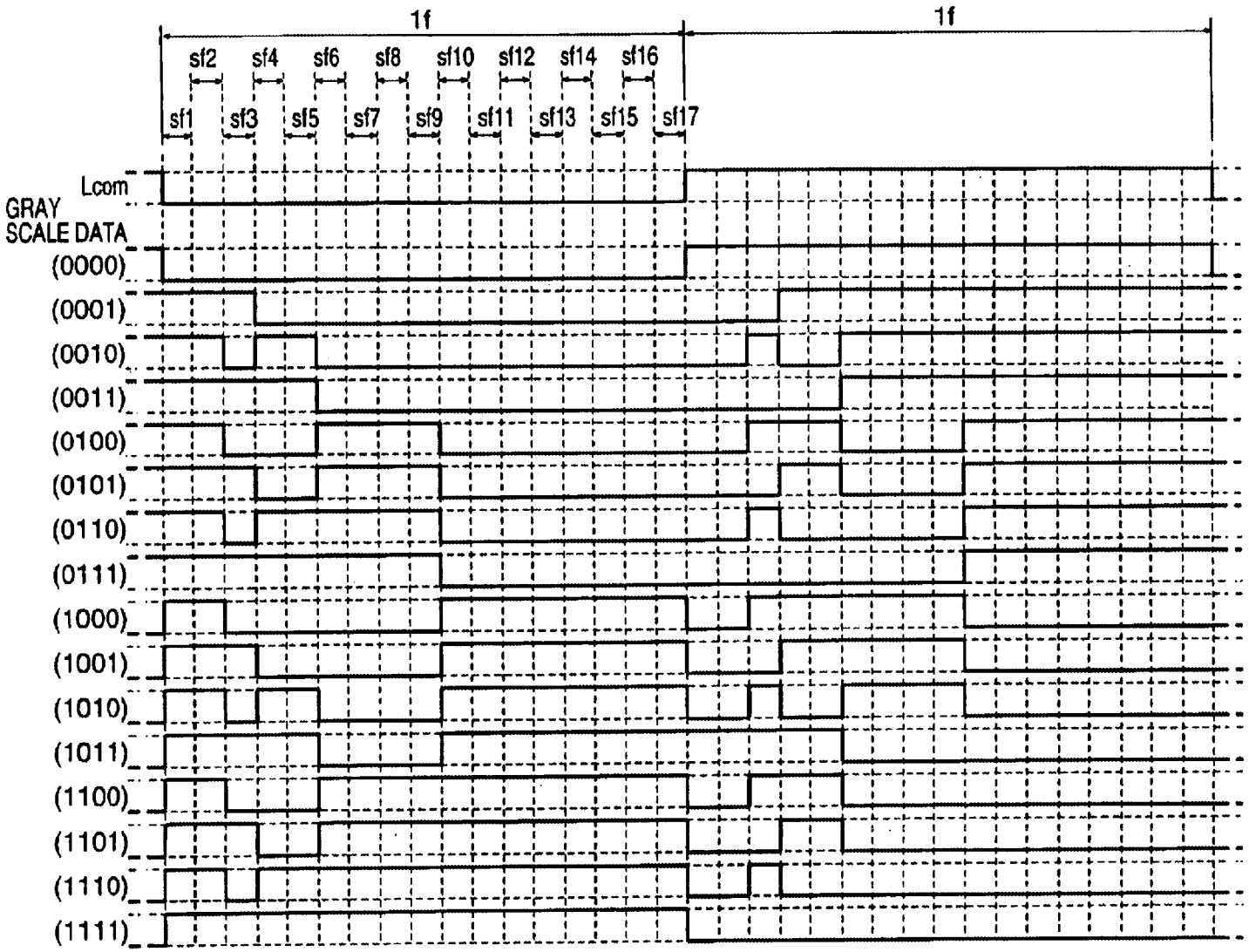
FIG. 11 is a timing chart showing by the subfield a voltage applied to an opposing substrate and a voltage applied to a pixel electrode in the same electro-optical device for each gray scale data.

Next, the voltage applied to the liquid crystal layer in the pixel 110 through such an operation is considered. FIG. 11 is a timing chart showing the waveform of the signal Lcom applied to the counter electrode 108 and the waveform applied to the pixel electrode 118 in the pixel 110 on a subfield-by-subfield basis for each gray scale data. The waveform applied to the pixel electrode 118 is the one to the pixels 110 positioned on the first scanning line 112 from the top, by way of example.

For example, if gray scale data (dcba) to a particular pixel 110 is (0000) in one field (1f) where the signal Lcom is low, the low level having the same potential as the signal Lcom applied to the counter electrode 108 is applied to the pixel electrode 118 of that pixel in one field (1f). Therefore, the effective voltage value applied to the liquid crystal layer is substantially zero, and the transmittance of that pixel becomes 0% according to the gray scale data (0000).

If gray scale data (dcba) to a particular pixel 110 is (1111), on the other hand, the high level having a potential inverted with respect to the signal Lcom is applied to the pixel electrode 118 of that pixel in one field (1f). Therefore, the effective voltage value applied to the liquid crystal layer becomes Vdd or a high level voltage, which is the maximum, and the transmittance of that pixel corresponds to the gray scale data (1111).

If gray scale data (dcba) to a particular pixel 110 is, for example, (0101), applied to the pixel electrode 118 of that pixel are the high level corresponding to "1" of the correction bit h in the subfields sf1 and sf2, the high level corresponding to "1" of the bit a in the subfield sf3, the low level corresponding to "0" of the bit b in the subfields sf4 and sf5, the high level corresponding to "1" of the bit c in the subfields sf6 to sf9, and the low level corresponding to "0" of the bit d in the subfields sf10 to sf17. Eventually, the high level is applied to the liquid crystal layer of that pixel in a period of 7/17 of one field, whose effective voltage value is determined by $(7/17)^{1/2}\cdot(Vdd-Vss)$, resulting in a transmittance corresponding to this effective voltage value.

If gray scale data (dcba) to a particular pixel is, for example, (1010), applied to the pixel electrode 118 of that pixel are the high level corresponding to "1" of the correction bit h in the subfields sf1 and sf2, the low level corresponding to "0" of the bit a of the gray scale data in the subfield sf3, the high level corresponding to "1" of the bit b in the subfields sf4 and sf5, the low level corresponding to "0" of the bit c in the subfields sf6 to sf9, and the high level corresponding to "1" of the bit d in the subfields sf10 to sf17.

Eventually, the high level is applied to the liquid crystal layer of that pixel in a period of 12/17 of one field, whose effective voltage value is determined by $(12/17)^{1/2}\cdot(Vdd-Vss)$, resulting in a transmittance corresponding to that effective voltage value. The other gray scale data will not need be described otherwise specifically.

In one field (1f) where the signal Lcom is high, on the other hand, the bit data Ds is in a reverse relation with respect to the bits of gray scale data and the correction bit h, and the inverted level in a field where the signal Lcom is high is applied to the pixel electrode 118. If the mean value between the high and low levels is considered as the voltage reference, therefore, the voltage applied to the liquid crystal layer in a field where the signal Lcom is low, and the voltage value applied to the liquid crystal layer in a field where the signal Lcom is high are inverted in polarity to each other, while their absolute values are equal. This obviates the situation where a DC component is applied to the liquid crystal layer, thereby preventing deterioration of the liquid crystal 105.

Accordingly, the electro-optical device according to the present embodiment requires no circuit, such as a high-precision D/A converting circuit and op amp, for processing an analog signal in a peripheral circuit such as a driving circuit because the data signals d1 to d320 supplied to the data lines 114 are only either high or low, namely, binary. In addition, no display nonuniformity resulting from unevenness in element characteristic, wiring resistance, etc., occurs in principle. The electro-optical device according to the present embodiment further requires that only 71 scanning lines 112, instead of all 240, be selected in one subfield, thereby reducing the data transfer rate to one third or lower.

Meanwhile, the electro-optical device according to the present embodiment has a structure in which the scanning lines 112 are selected in the order shown in FIG. 8 in each subfield. That is, as described above, the scanning lines 112 are selected in order from the top in each subfield, such that selection of a particular scanning line 112 in a particular subfield, and selection of the one upper scanning line 112 in the next subfield are performed in the identically numbered horizontal scan period.

In other words, according to the present embodiment, the scanning line 112 in which the reference time of weighting has arrived is selected in order from the top, although they are not selected in order from the first horizontal scan period H1. For example, in the subfield sf11, the eighth scanning line 112 from the top is first selected, whose selection period is not the first horizontal scan period H1 but the sixth horizontal scan period H6.

The reason why this structure is taken is only that the reference time of weighting is shifted by one subfield every scanning line in the present embodiment. That is, the structure in which the scanning lines 112 are selected in a predetermined order from the top and are selected in order from the first horizontal scan period H1 may lead the following inconveniences.

For example, in a contemplated structure, if the fourth scanning line 112 from the top is focused, it is selected in the third horizontal scan period H3 in the subfield sf3, while it is first selected, namely, in the first horizontal scan period H1, in the subfield sf7, thereby making the duration when the voltage corresponding to the bit c of gray scale data is applied two horizontal scan period shorter than the original duration. On the other hand, if the fifth scanning line 112 from the top is focused, it is selected in the third horizontal scan period H3 in the subfield sf2, while it is second selected, namely, in the second horizontal scan period H2, in the subfield sf6, thereby making the duration when the voltage corresponding to the bit c of gray scale data is applied one horizontal scan period shorter than the original duration. Consequently, the duration of applying the voltage corresponding to the bit c of gray scale data differs between the pixels 110 positioned on the fourth scanning line 112 from the top, and the pixels 110 positioned on the fifth scanning line 112 from the top. The same is true if other scanning lines are focused. The fact that the duration of applying a voltage corresponding to the same bit of gray scale data (or the correction bit) differs from one scanning line 112 to another means a different transmittance even if the gray scale data to the pixels 110 is the same. Thus, this structure would inevitably reduce the display quality.

On the other hand, the electro-optical device according to the present embodiment has a structure in which although the scanning lines are selected in order from the top in each subfield, selection of a particular scanning line 112 in a particular subfield and selection of one upper scanning line 112 in the next subfield are performed in the identically numbered horizontal scan period.

Figure 12:
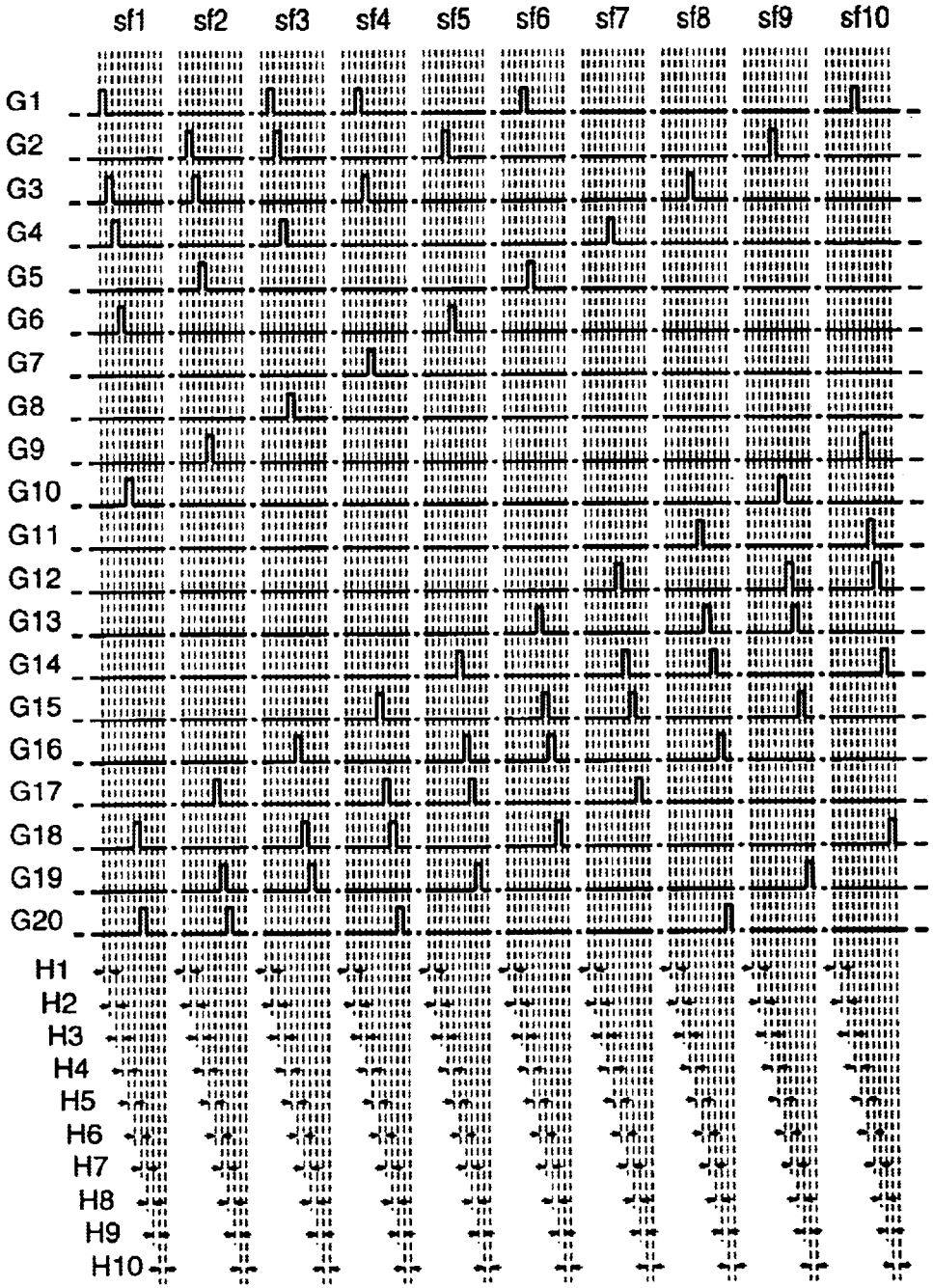
FIG. 12 is a timing chart showing a relationship between a scanning line and horizontal scan period in the same electro-optical device.

This structure makes the duration when the voltage corresponding to the bit a, b, or d of gray scale data, or the correction bit h is applied one horizontal scan period longer than the original duration, as shown in FIG. 12. According to the present embodiment, however, the one horizontal scan period extension of the duration of applying a voltage is common to all scanning lines, as well as to the bits a, b, c, and d of gray scale data, and the correction bit h. According to the present embodiment, therefore, extension in duration of applying a voltage can uniformly influence all of the pixels 110, thereby preventing a reduction in the display quality in addition to the foregoing advantages (a simplified circuit structure, prevention of nonuniform display resulting from unevenness, or reduction in data transfer rate).

Although the scanning lines 112 are selected in the order referenced in the table shown in FIG. 8 to make the durations when voltages corresponding to the bits of gray scale data and the correction bit are applied uniform, it should be understood that the present invention is not limited thereto. For example, the same advantage can be taken by referencing a table shown in FIG. 13.

Figure 13:
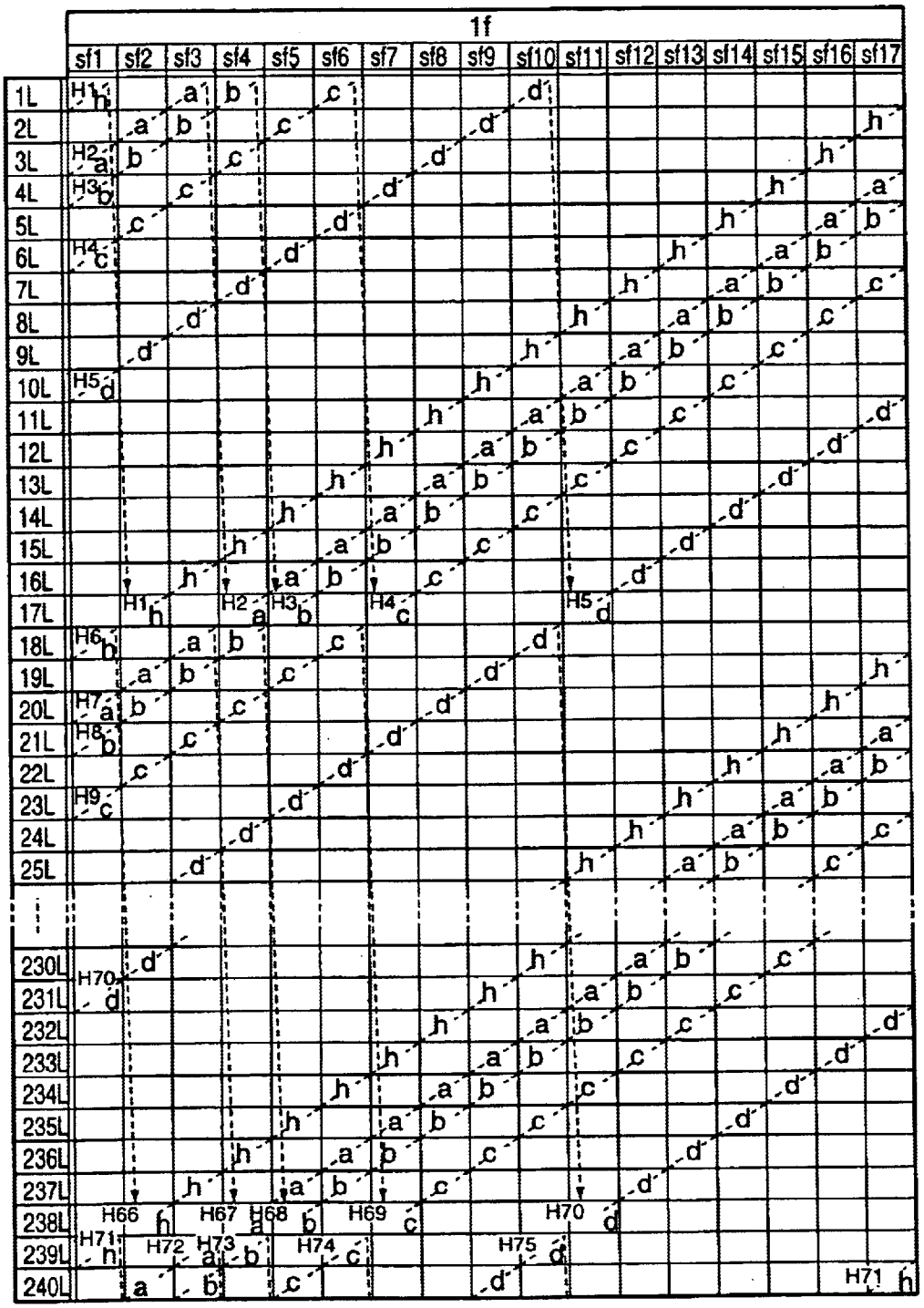
FIG. 13 is a view showing a relationship between selection of each scanning line and the reference time of weighting by the subfield in an electro-optical device according to a modified form of the present invention.

FIG. 13 is a view showing a relationship, for each subfield, between selection of scanning lines and the reference time of weighting in an electro-optical device according to this modified form. As shown in this figure, in this electro-optical device, although the timing of weighting of the bits of gray scale data (the correction bit) is completely the same as that in the above-described embodiment, every 17 scanning lines 112 are grouped into a block, and each of the blocks is sequentially selected in one subfield. For example, in each subfield, a first block consisting of the first to 17th ones from the top is first selected, a second block consisting of the 18th to 34th ones from the top is then selected, and so are the subsequent blocks in the same manner, a 14th block consisting of the 222th to 238th ones from the top being selected, and finally a 15th block consisting of a fraction of 239th and 240th ones is selected.

Furthermore, in this electro-optical device, in a selected block, writing to the correction bit h, and the bits a, b, c, and d of gray scale data is sequentially performed every one horizontal scan period. In other words, each block is sequentially selected every five horizontal scan periods, and, in a selected block, five scanning lines 112 are selected one-by-one in one horizontal scan period.

Therefore, for example, if the first block is selected in the subfield sf4, the 15th scanning line 112 from the top is selected in the first horizontal scan period H1 to perform writing to the correction bit h; the 17th scanning line 112 from the top is selected in the second horizontal scan period H2 to perform writing to the bit a of gray scale data; the first scanning line 112 from the top is selected in the third horizontal scan period H3 to perform writing to the bit b of gray scale data; the third scanning line 112 from the top is selected in the fourth horizontal scan period H4 to perform writing to the bit c of gray scale data; and the seventh scanning line 112 from the top is selected in the fifth horizontal scan period H5 to perform writing to the bit d of gray scale data.

In this regard, the point where selection of a particular scanning line in a particular subfield and selection of the one upper scanning line in the next subfield are performed in the identically numbered horizontal scan period is common to the above-described embodiment. Therefore, the duration when the voltage corresponding to the bit a, b, or c of gray scale data, or the correction bit h is applied is made one horizontal scan period longer than the original duration, while the duration when the voltage corresponding to the bit d of gray scale data is applied is made four horizontal scan periods shorter than the original duration. However, this is common to all scanning lines, as well as to the bits a, b, c, and d of gray scale data, and the correction bit h, thereby preventing reduction in the display quality.

In the above-described embodiment, the signal Lcom applied to the counter electrode 108 is level-inverted every one field in order to achieve AC driving, and the value of the bits of gray scale data or the correction bit is forwarded or inverted, and is output as bit data Ds. However, such AC driving can also be performed in the following modified form.

Figure 15:
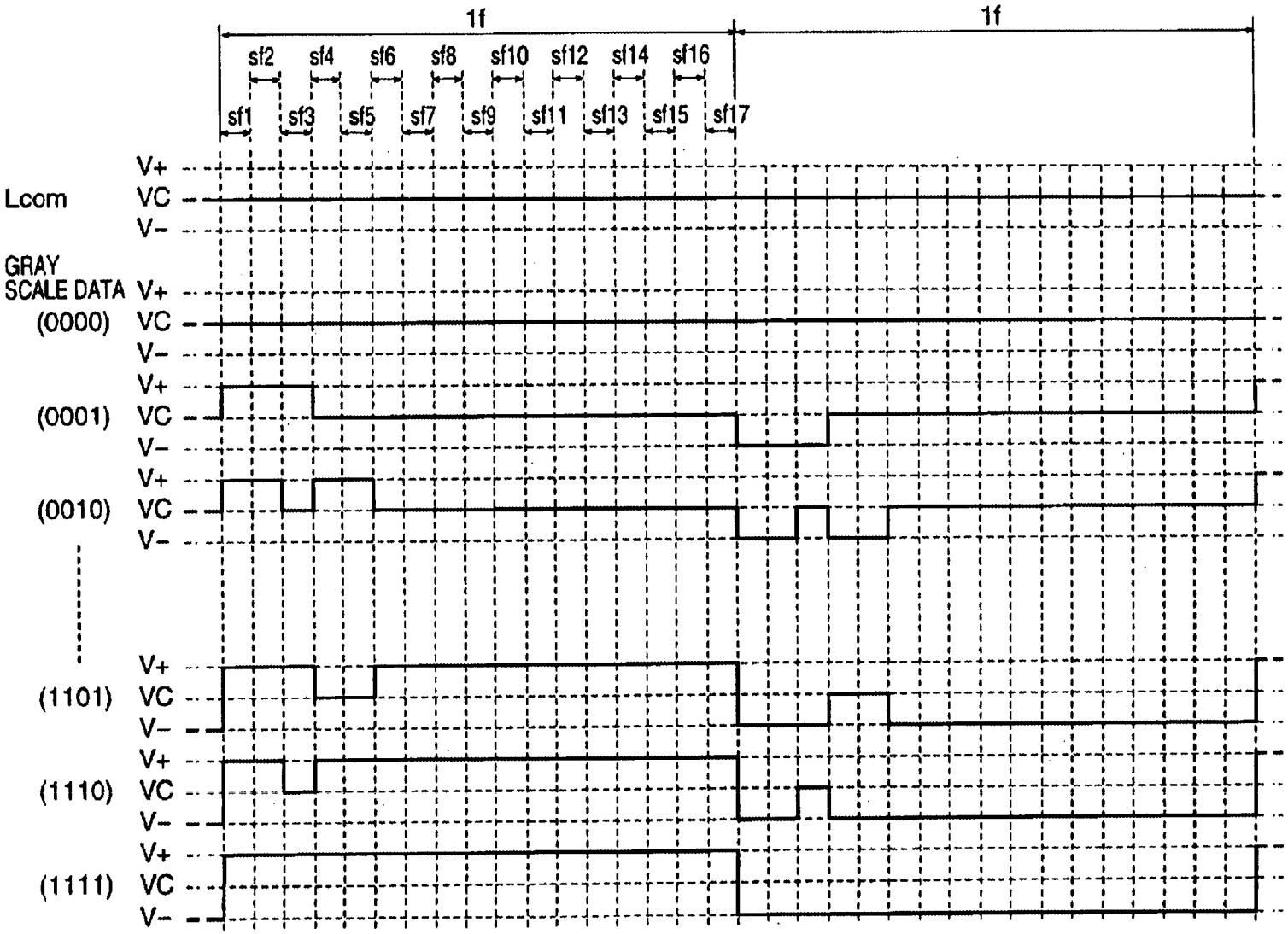
FIG. 15 is a timing chart showing by the subfield a voltage applied to an opposing substrate and a voltage applied to a pixel electrode in an electro-optical device according to another modified form that is different from the modified form for each gray scale data.

FIG. 15 is a timing chart showing the waveform of the signal Lcom applied to the counter electrode 108 and the waveform applied to the pixel electrode 118 in the pixel 110 for each gray scale data of that pixel. The waveform applied to the pixel electrode 118 is the one to the pixels positioned on the first scanning line 112 from the top, by way of example, as in FIG. 11.

As shown in this figure, an electro-optical device according to this modified form has a structure in which the signal Lcom applied to the counter electrode 108 and the voltage corresponding to the low level of the bit data Ds are fixed as voltage Vc regardless of fields, while the voltage corresponding to the high level of the bit data is inverted every field as a symmetric voltage V+ or V− with reference to Vc.

A voltage applied to the liquid crystal layer in the pixel 110 with this structure is studied with reference to FIG. 15. For example, if gray scale data (dcba) to a pixel 110 is (0000), Vc having the same potential as the signal Lcom applied to the counter electrode 108 is applied to the pixel electrode 118 of that pixel, and the effective voltage value becomes zero.

If gray scale data (dcba) to a pixel 110 is (1111), on the other hand, the voltage V+ corresponding to the high level is applied to the pixel electrode 118 of that pixel in one field, while the voltage V− which is inverted with respect to the voltage Vc is applied in the next field.

If gray scale data (dcba) to a pixel 110 is, for example, (0010), the voltage V+, or the high level, corresponding to "1" of the correction bit h, the voltage Vc, or the low level, corresponding to "0" of the bit a of gray scale data, the voltage V+ corresponding to "1" of the bit b, the voltage Vc corresponding to "0" of the bit c, and the voltage Vc corresponding to "0" of the bit d are applied to the pixel electrode 118 of that pixel in the subfields sf1 and sf2, in the subfield sf3, in the subfields sf4 and sf5, in the subfields sf6 to sf9, and in the subfields sf10 to sf17 in one field (1f), respectively. In the next one field (1f), on the other hand, the voltage V−, in place of the voltage V+, is applied in the subfields sf1, sf2, sf4, and sf5 as the high level, and Vc having the same potential as the counter electrode 108 is applied as the low level in the other subfields.

If the difference between the voltage V+ and the voltage Vc (the difference between the voltage V− and the voltage Vc) is equal to the difference between the voltage Vdd and the voltage Vss in the above-described embodiment, a transmittance corresponding to the effective voltage value is provided, thereby also achieving gray scale display using AC driving in the electro-optical device according to this modified form. The other gray scale data will not need be described otherwise specifically.

Although one field represents the period when the signal Lcom is inverted or the period when the voltage corresponding to the high level of the bit data Ds is inverted in the electro-optical device according to this modified form or the above-described embodiment, the present invention is not limited thereto, and the level may also be inverted in, for example, a period as long as two or more fields, or a period as short as one horizontal scan period or two horizontal scan periods.

Figure 16:
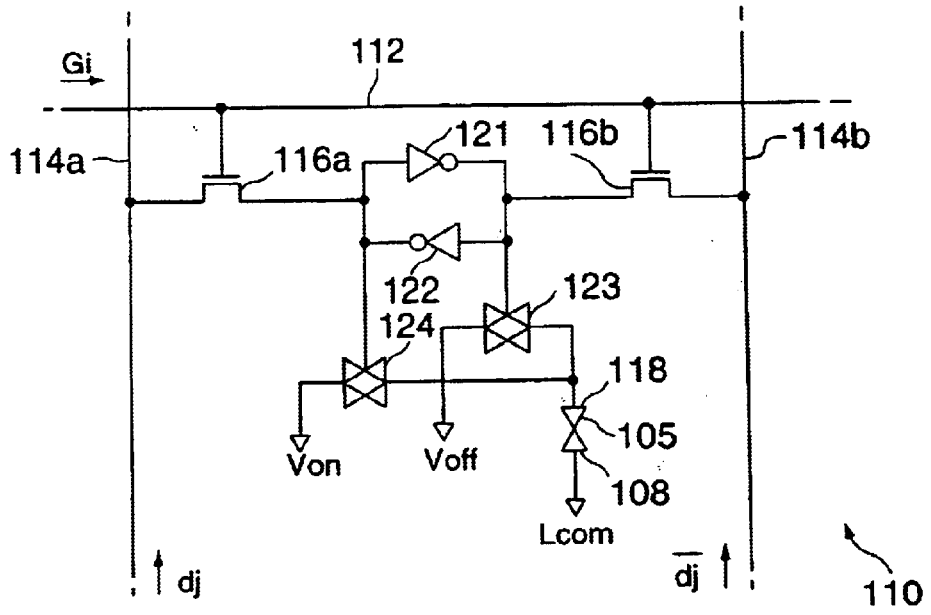
FIG. 16 is a circuit diagram of an example structure of a pixel feasible in the present invention.

It should be understood that the structure of the pixel 110 is not limited to that shown in FIG. 2(*a*) or (*b*), but a variety of structures may be implemented. For example, the structure shown in FIG. 16 may be implemented.

In this figure, a normal data signal $\overline{dj}$ (bit data Ds) is supplied to a data line 114*a*, while an inverted data signal /dj is supplied to a data line 114*b*. At intersections between a scanning line 112 and both data lines 114*a* and 114*b*, the data signal dj supplied via the data line 114*a* is supplied to the input port of an inverter 121 via a transistor 116*a*, and the inverted data signal $\overline{dj}$ supplied via the data line 114*b* is supplied to the input port of an inverter 122 via a transistor 116*b*.

In the inverters 121 and 122, the output port of one inverter is connected to the input port of the other, and, out of these, an output signal of the inverter 121 (an input signal of the inverter 122) becomes a control signal of a transmission gate 123 for supplying an off signal Voff to a pixel electrode 118, while an output signal of the inverter 122 (an input signal of the inverter 121) becomes a control signal for a transmission gate 124 for supplying an on signal Von to the pixel electrode 118.

If the signal Lcom is level-inverted every predetermined time period as in the above-described embodiment, the on signal Von becomes an inverted level signal with respect to the signal Lcom, while the off signal Voff becomes a signal having the same level as the signal Lcom.

In this case, if the high level as the data signal dj (the low level as the inverted level signal $\overline{dj}$) is supplied, the on signal Von which is level-inverted with respect to the signal Lcom applied to the counter electrode 108 is applied to the pixel electrode 118, while, if the low level as the data signal dj (the high level as the inverted level signal $\overline{dj}$) is supplied, the off signal Voff having the same level as the signal Lcom applied to the counter electrode 108 is applied to the pixel electrode 118. In this case, when the bit data Ds is output from the bits a, b, c, and d of gray scale data, and the correction bit h, it needs not be forwarded or inverted depending upon the level of the signal Lcom.

If the signal Lcom is fixed as the voltage Vc as in the above-described modified form (2), the on signal Von is level-inverted alternately between the voltages V+ and V− every predetermined period (for example, every one field), while the off signal Voff is a constant signal having the same level as the signal Lcom.

In this case, if the high level as the data signal dj (the low level as the inverted level signal $\overline{dj}$) is supplied, a signal having either voltage V+ or V− which is applied to the counter electrode 108 is applied to the pixel electrode 118, while, if the low level as the data signal dj (the high level as the inverted level signal $\overline{dj}$) is supplied, the off signal Voff having the same level as the signal Lcom is applied to the pixel electrode 118. Also in this case, therefore, when the bit data Ds is output from the bits a, b, c, and d of gray scale data, and the correction bit h, it needs not be forwarded or inverted depending upon the level of the signal Lcom.

Figure 17:
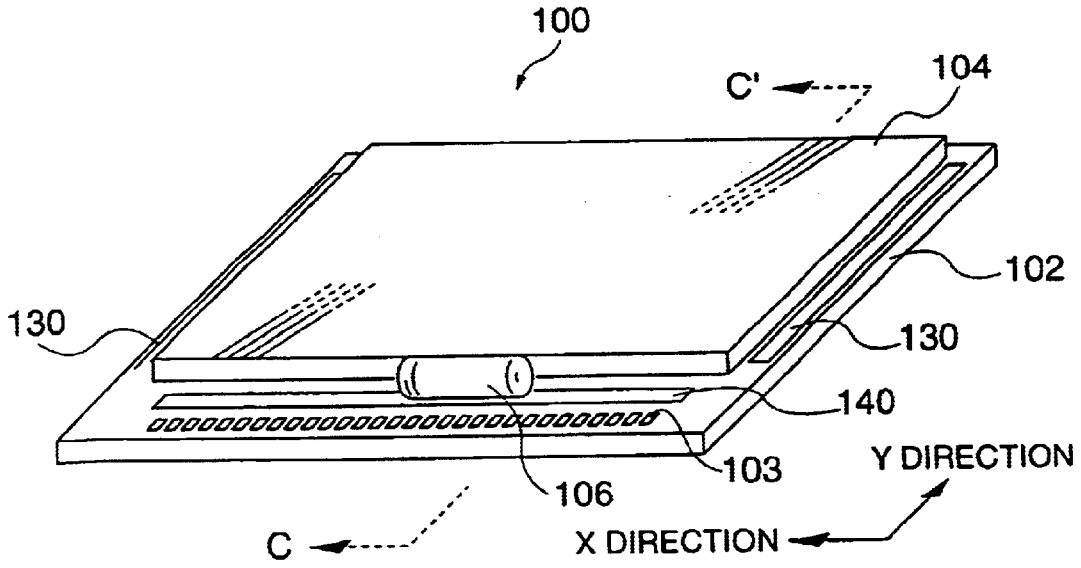
FIG. 17 is a perspective view of the structure of an electro-optical device according to an embodiment of the present invention.
Figure 18:
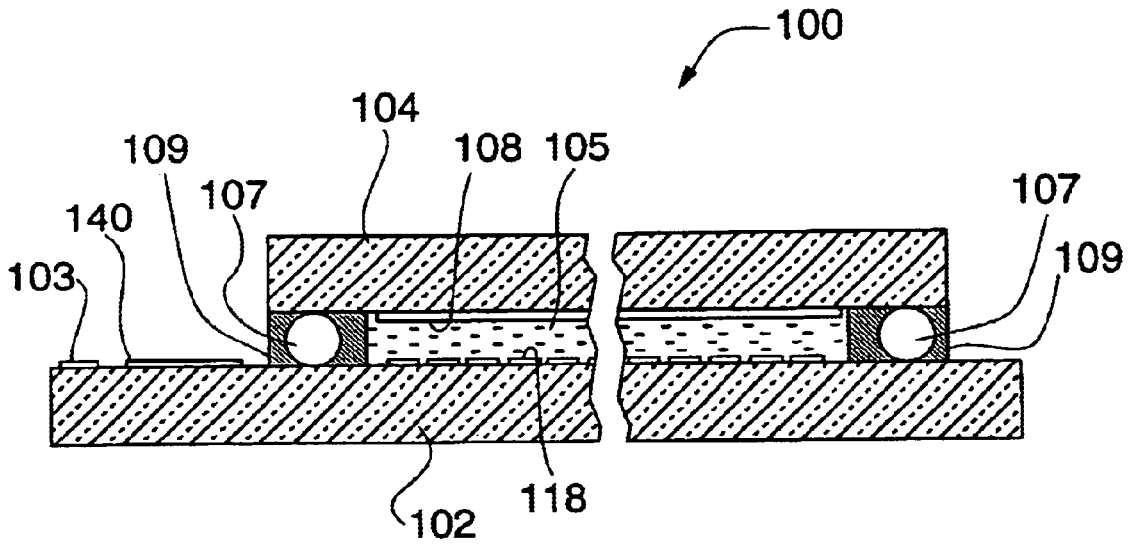
FIG. 18 is a cross-sectional view of the structure of the same electro-optical device.

The overall structure of the electro-optical device according to the above-described embodiment is now described with reference to FIGS. 17 and 18. FIG. 17 is a perspective view of the structure of an electro-optical device 100, and FIG. 18 is a cross-sectional view of that shown in FIG. 17, taken along the line C–C'.

As shown in these figures, the electro-optical device 100 is constructed in such a manner that an element substrate 102 including glass, semiconductor, quartz, or the like on which pixel electrodes 118, etc., are formed, and an opposing transparent substrate 104 including glass on which a counter electrode 108, etc., are formed are bonded to each other with a sealing material 109 mixed with a spacer 107, keeping a constant spacing so that their electrode-formed surfaces face each other and liquid crystal 105 as an electro-optical material is encapsulated into the spacing. The sealing material 107 is formed along the perimeter of the opposing substrate 104, but has a portion thereof open in order for the liquid crystal 105 to be injected. For this reason, the opening portion is sealed with a sealant 106 after injection of the liquid crystal 105.

The above-described data line driving circuit 140 is formed at one side of the opposing surface of the element substrate 102 outside the sealing material 109 so as to drive data lines 114 extending in the Y direction. A plurality of external circuit connection terminals 103 are also formed at this side so that various signals from the control circuit 200 can be input. At the two sides adjacent to this side, two scanning line driving circuits 130 are formed to drive scanning lines 112 extending in the X direction from both sides. If the delay of scan signals supplied to the scanning lines 112 is not critical, only one scanning line driving circuit 130 may be formed at either side.

On the other hand, the counter electrode 108 on the opposing substrate 104 is in electrical connection with the connection terminals 103 on the element substrate 102 through a conducting material (not shown) positioned at least one of the four bonded comers. That is, the signal Lcom is applied to one end of the storage capacitance 109 via the connection terminals 103 formed on the element substrate 102, and also to the counter electrode 108 via the conducting material.

Alternatively, depending upon the usage of the electro-optical device 100, for example, for a direct-viewing type, the opposing substrate 104 is provided with, first, color filters which are arranged into strips, a mosaic, triangles or the like, and, second, a light-shielding film (black matrix) made of a metal material or resin. For use in chromatic modulation, for example, if it is used as a light valve for a projector described below, no color filter is formed.

Alignment films (not shown) which have been rubbed into a predetermined direction and the like are formed on the electrode-formed surfaces of the element substrate 102 and the opposing substrate 104 so that the alignment direction of liquid crystal molecules in the state where no voltage is applied is set. A light polarizer (not shown) according to the alignment direction is further placed on the outer sides (observing sides) of the element substrate 102 and the opposing element 104 for the transmission type, or only on the outer side of the opposing substrate 102 for the reflection type. If a polymer-dispersed liquid crystal in which very small molecules are dispersed in a polymer is implemented as the liquid crystal 105, the aforementioned alignment film or light polarizer is not required, resulting in increased efficiency of light utilization, and thus providing advantages in view of higher brightness or lower power consumption.

In the above-described embodiment or modified forms, the number of gray scale level s is "16," but it should be understood that 8 gray scale levels or a smaller number of gray scale levels may be used, or a higher number of gray scale levels such as 64-gray scale level display and 256 gray scale level s may be used.

Furthermore, in the embodiment or modified forms, the reference time of weighting is shifted so as to temporally advance every scanning line by one subfield. However, it should be understood that a variety of shifting techniques may be contemplated. For example, the reference time of weighting may be temporally delayed, or may be shifted by two or more subfields.

Figure 14:
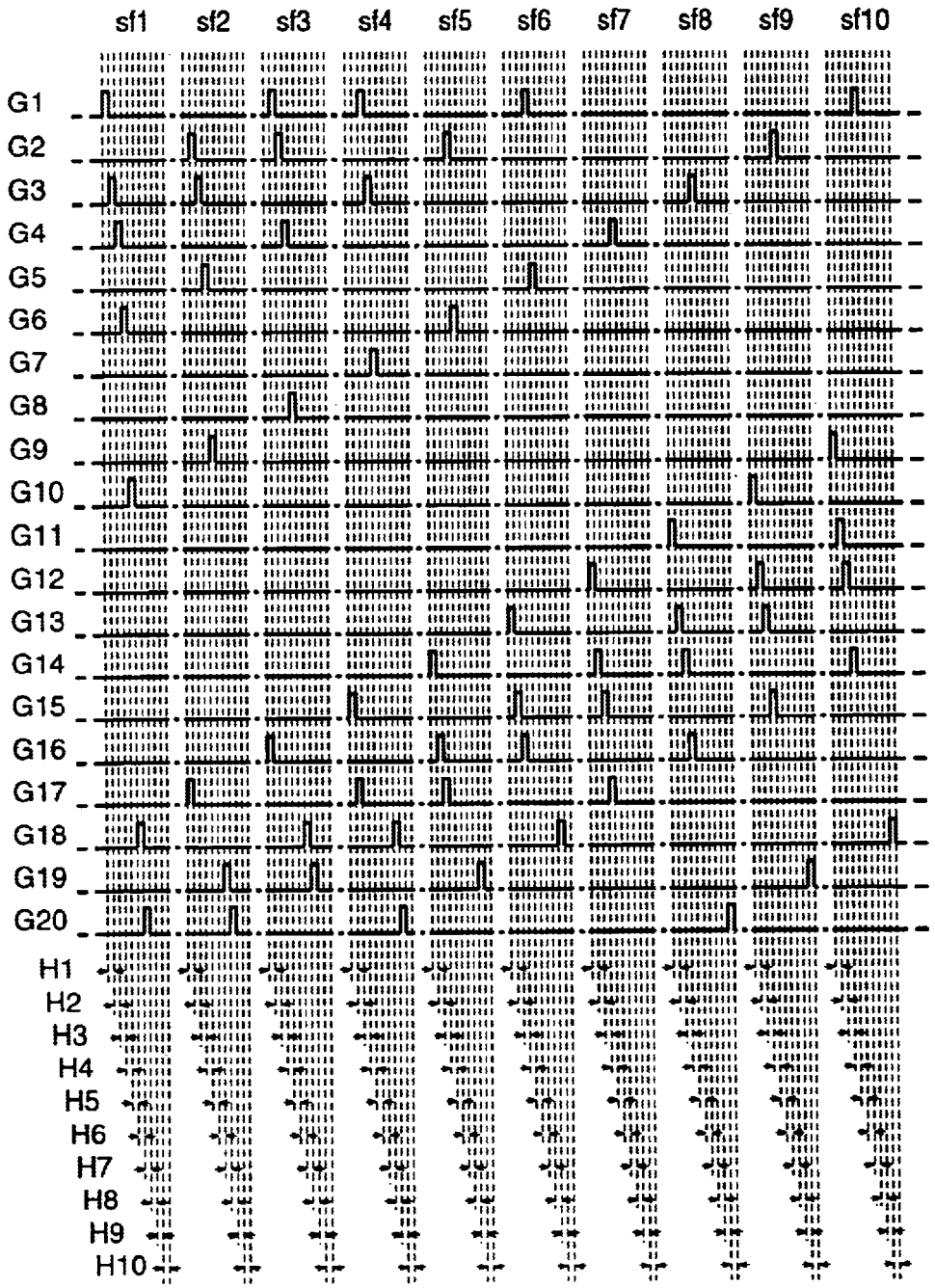
FIG. 14 is a timing chart showing a relationship between a scanning line and a horizontal scan period in the same electro-optical device.

Furthermore, in the embodiment or modified forms, the TFTs 116 are formed on the element substrate 102, but the present invention is not limited thereto. For example, the element substrate 102 may be a semiconductor substrate, and MOS transistors may be formed thereon in place of the TFTs 116. In addition, using an SOI (Silicon On Insulator) technique, a silicon single crystal film may be formed on an element substrate 102 formed of an isolating substrate made of sapphire or the like, and various elements may be created thereon. In particular, if the pixels 110 are constructed in the manner shown in FIGS. 14 or 15, such a technique may be useful since the number of elements per pixel is greater with complexity. However, such a structure may cause the element substrate 102 to be non-transmissive, and thus requiring the reflection type by making the pixel electrode 108 formed of aluminum, by providing a separate reflection layer, or the like.

Furthermore, the TN (Twisted Nematic) type is used as the liquid crystal in the above-described embodiment or modified forms, but liquid crystal of the STN (Super Twisted Nematic) type having a twisted alignment of over 180°, the bi-stable type such as the BTN (Bi-stable Twisted Nematic) type, the ferroelectric type having a memory property, the polymer-dispersed type, the guest host type in which dye (guest) having an anisotropic property for absorption of visible light in the long and short axial directions of molecules is mixed with liquid crystal (host) having a constant molecular alignment so that the dye molecules and the liquid crystal molecules are aligned in parallel, or the like may also be used without departing from the spirit and scope of the present invention.

Also available are a perpendicular alignment (homeotropic alignment) structure in which liquid crystal molecules are aligned in the direction perpendicular to both substrates when no voltage is applied, while liquid crystal molecules are aligned in the direction horizontal to both substrates when a voltage is applied, or the structure of parallel (horizontal) alignment (homogeneous alignment) in which liquid crystal molecules are aligned in the direction horizontal to both substrates when no voltage is applied, while liquid crystal molecules are aligned in the direction perpendicular to both substrates when a voltage is applied. Furthermore, it is not necessary that the counter electrode 108 be formed on the opposing substrate 104, but pixel electrodes and counter electrodes may be arranged on the element substrate 102 in an interdigital fashion with a spacing therebetween. With this structure, liquid crystal molecules are aligned horizontally, and the alignment direction of the liquid crystal molecules changes with electric fields in the transverse direction between the electrodes. In this way, a variety of liquid crystals or alignment methods may be used as long as they are suitable for the driving method according to the present invention.

In addition, implemented as the electro-optical device may be a variety of electro-optical devices, in place of a liquid crystal device, including an electroluminescent (EL) device, a digital micro-mirror device (DMD), and a display device using fluorescence by plasma lighting or electron emission, etc., utilizing their electro-optical effects. The electro-optical materials in this case comprise an EL material, a mirror device, a gas, a fluorescent material, etc. If an EL material is used as an electro-optical material, the EL material will be interposed between the pixel electrodes 108 and the counter electrode 108 of a transparent conductive film, thereby eliminating the need of the opposing substrate 102.

Accordingly, the present invention is applicable to electro-optical devices having a similar structure to the above-described structures, in particular, all of the electro-optical devices using pixels for performing on-or-off binary display to perform gray scale display.

Figure 19:
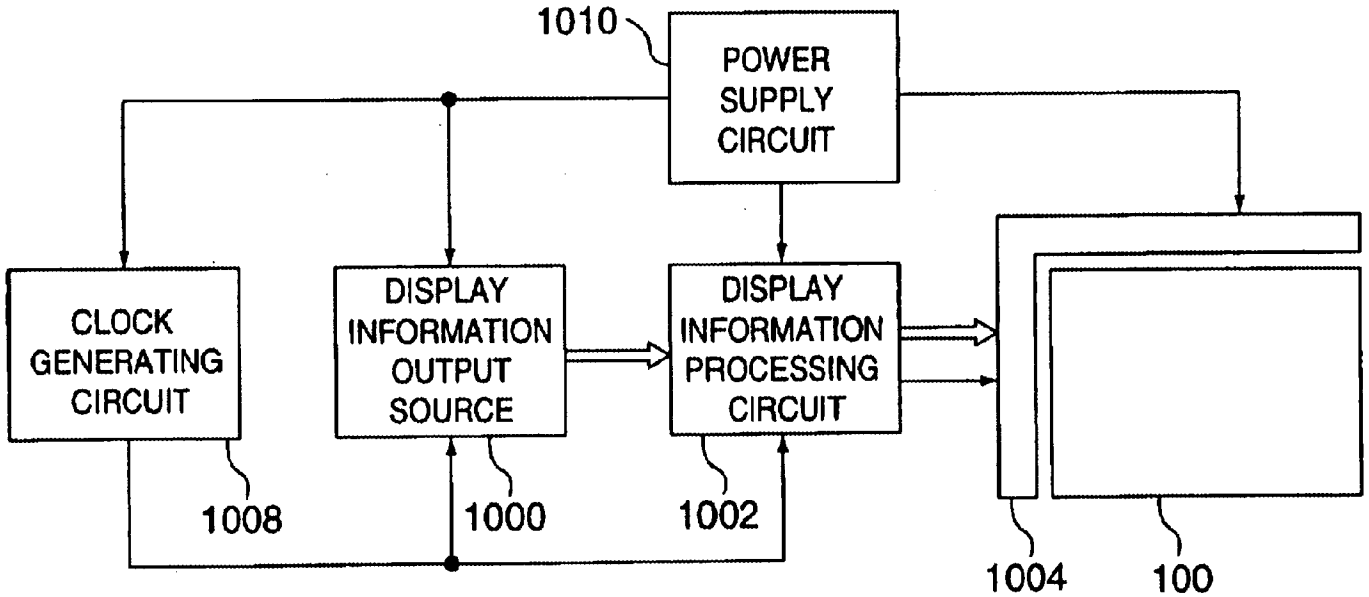
FIG. 19 is a block diagram of the electrical structure of electronic apparatus incorporating the same electro-optical device.

Next, the case where the above-described electro-optical device is applied to various kinds of electronic apparatus is described. In this case, as shown in FIG. 19, electronic apparatus mainly includes a display information output source 1000, a display information processing circuit 1002, a driving circuit 1004, a liquid crystal display 100, a clock generating circuit 1008, and a power supply circuit 1010. Out of these, the display information output source 1000 includes a memory such as a ROM (Read Only Memory) or a RAM (Random Access Memory), a storage unit such as an optical disc device, a tuning circuit for tuning an image signal for output, and the like, and outputs display information, such as an image signal of a predetermined format, to the display information processing circuit 1002 based on a clock signal from the clock generating circuit 1008. The display information processing circuit 1002 includes, in addition to the above-noted control circuit 200, various processing circuits, such as a well-known gamma correction circuit and clamping circuit, and sequentially generates a digital signal from the input display information to output it to the driving circuit 1004 together with the clock signal. The driving circuit 1004 drives the electro-optical device 100, and includes a test circuit for use in tests after production, in addition to the aforementioned scanning line driving circuit 130 or data line driving circuit 140. The power supply circuit 1010 supplies predetermined power to the above-described circuits.

Next, some specific examples where the above-described liquid crystal device is applied to electronic apparatus are described.

Figure 20:
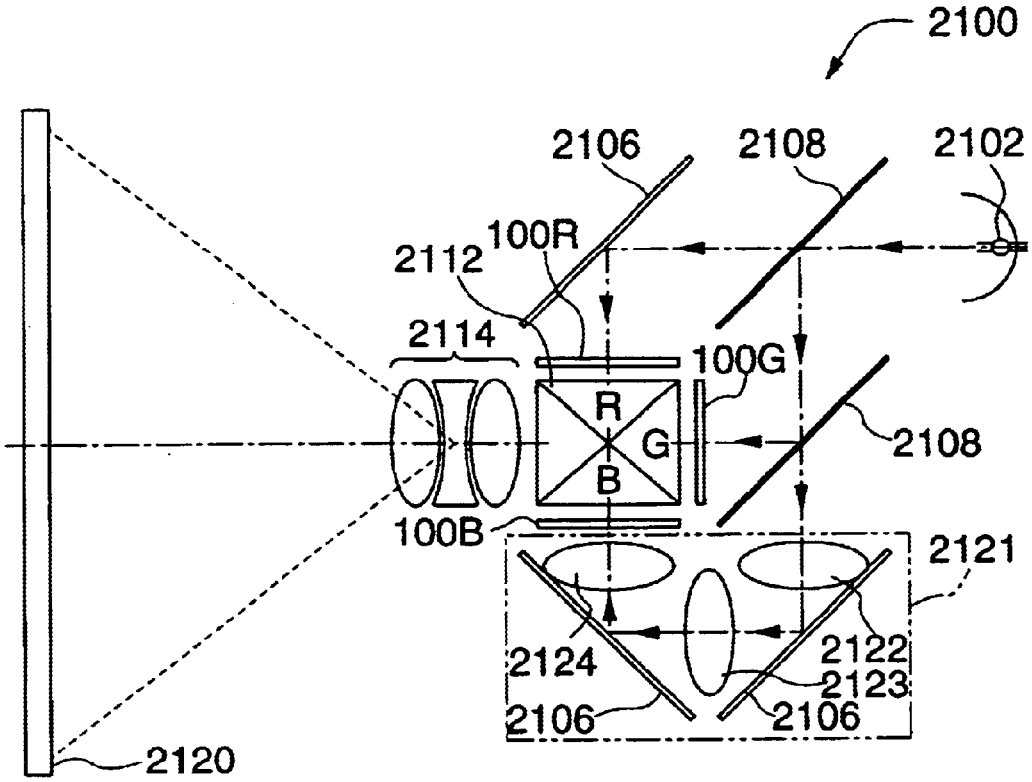
FIG. 20 is a cross-sectional view of the structure of a projector as an example of the electronic apparatus incorporating the same electro-optical device.

First, a projector using the electro-optical device 100 as a light valve is described. FIG. 20 is a plan view of the structure of the projector. As shown in this figure, a lamp unit 2102 formed of a white light source such as a halogen lamp is placed within a projector 2100. The projection light emitted from the lamp unit 2102 is separated into three primary colors R, G, and B by three mirrors 2106 and two dichroic mirrors 2108 which are internally positioned, and is then directed to light valves 100R, 100G, and 100B corresponding to the respective primary colors. The structure of the light valves 100R, 100G, and 100B is the same as that of the above-described electro-optical device 100, in which they are respectively actuated by R, G, and B primary color signals which are supplied from an image signal processing circuit (not shown). B colored light has a longer light path than the other colors R and G, and is thus directed through a relay lens system 2121 formed of an incident lens 2122, a relay lens 2123, and an exit lens 2124 in order to avoid loss.

Then, the light which has been modulated by the light valves 100R, 100G, and 100B enters a dichroic prism 2112 from three directions. The light of R and B colors is deflected by 90° by the dichroic prism 2122, while the G colored light travels straight. As a result of combining the images of these colors, therefore, a color image is projected onto a screen 2120 through a projector lens 2114.

The light corresponding to the primary colors R, G, and B is incident onto the light valves 100R, 100G, and 100B through the dichroic mirrors 2108, and there is no need to provide a color filter, as described above.

Figure 21:
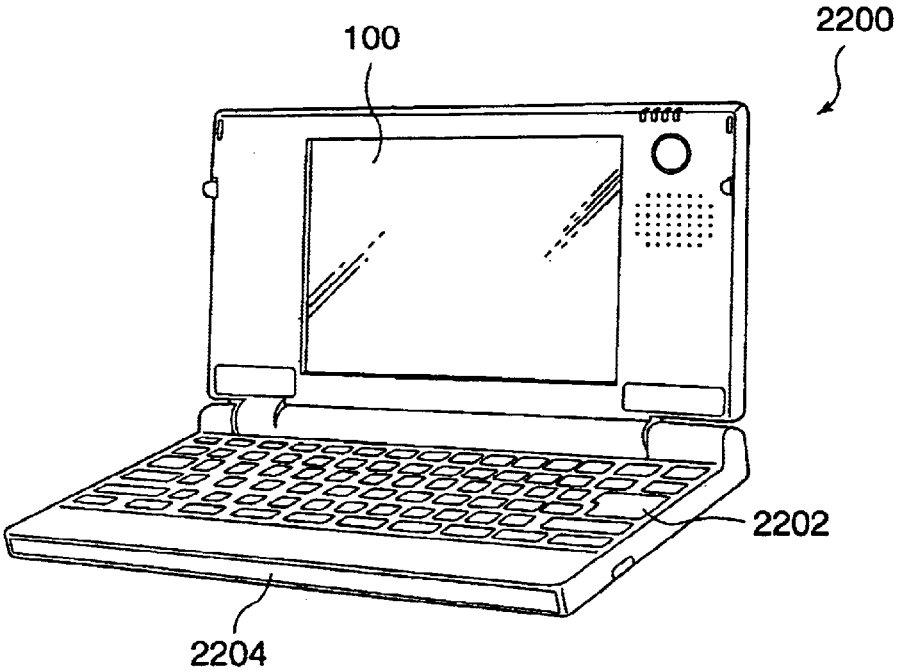
FIG. 21 is a perspective view of the structure of a personal computer as an example of the electronic apparatus incorporating the same electro-optical device.

Next, an example where the electro-optical device 100 is applied to a mobile personal computer is described. FIG. 21 is a perspective view of the structure of the personal computer. In the figure, a computer 2200 includes a main body 2204 with a keyboard 2202, and an electro-optical device 100 for use as a display unit. A backlight is provided on the rear of the electro-optical device 100 in order to enhance the visibility.

Figure 22:
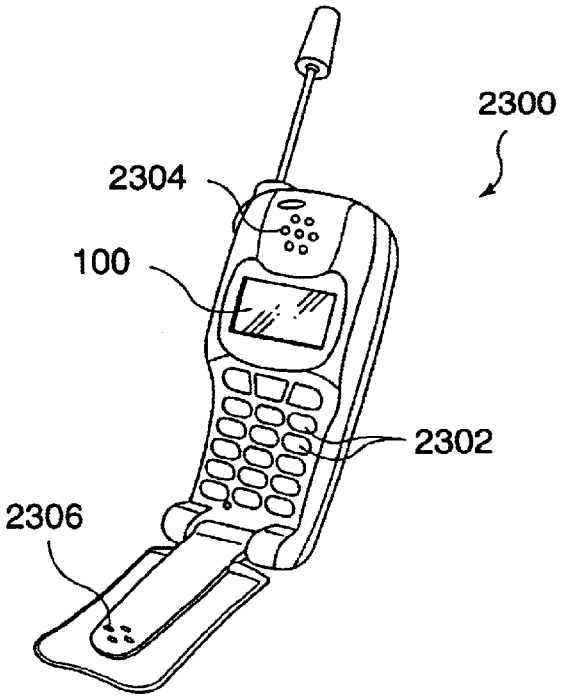
FIG. 22 is a perspective view of the structure of a cellular telephone as an example of the electronic apparatus incorporating the same electro-optical device.

A further example where the electro-optical device 100 is applied to a cellular telephone is described. FIG. 22 is a perspective view of the structure of the cellular telephone. In the figure, a cellular telephone 2300 includes a plurality of operational buttons 2302, as well as an earpiece 2304, a mouthpiece 2306, and the above-described electro-optical device 100. Again, a backlight is provided on the rear of the electro-optical device 100 in order to enhance the visibility.

In addition to those described with reference to FIGS. 19 to 22, electronic apparatus can include a liquid crystal television set, a video tape recorder of the viewfinder type or the monitor direct-viewing type, a car navigation apparatus, a pager, an electronic organizer, a calculator, a word processor, a workstation, a TV telephone, a POS terminal, apparatus with a touch panel and the like. It is needless to say that the electro-optical device according to the embodiment or modified forms is applicable to these various kinds of electronic apparatus.

As described above, according to the present invention, display nonuniformity resulting from unevenness in circuit characteristic, various wiring resistances, etc., can be reduced, and it is not necessary to sequentially select all scanning lines in each subfield, but is sufficient to select only the scanning line in which the reference time of weighting has arrived, thereby reducing the data transfer rate in one subfield. This also makes it possible to reduce the power consumption.

What is claimed is:

1. A method for driving an electro-optical device, comprising:

turning on or off a pixel by a subfield, the subfield being a unit obtained by dividing one field into subfields, according to a weighting of gray scale data indicating a gray scale level of the pixel, the pixel being positioned at a location corresponding to each intersection between a plurality of scanning lines and a plurality of data lines; and causing a reference time of weighting for the gray scale data to be shifted every scanning line and every subfield;

a plurality of scanning lines being placed into a plurality of blocks, each of the blocks being selected in a predetermined order in each subfield, and the scanning line in which the reference time of weighting has arrived, being selected in a predetermined order in a selected block; and selection of one particular scanning line in the subfield and selection of a scanning line adjacent thereto in the next subfield being performed in an identically numbered horizontal scan period.

2. A driving circuit for an electro-optical device, wherein a pixel is turned on or off by a subfield, the subfield being a unit obtained by dividing one field into subfields, according to a weighting of gray scale data indicating a gray scale level of the pixel, the pixel being positioned at a location corresponding to each intersection between a plurality of scanning lines and a plurality of data lines, and a reference time of weighting for the gray scale data is shifted every scanning line and every subfield, and a plurality of scanning lines being placed into a plurality of blocks, each of the blocks being selected in a predetermined order in each subfield, and the scanning line in which the reference time of weighting has arrived being selected in a predetermined order in a selected block, and selection of one particular scanning line in the subfield and selection of a scanning line adjacent thereto in the next subfield being performed in an identically numbered horizontal scan period, the driving circuit comprising:

a scanning line driving circuit that selects a scanning line in which a reference time of weighting has arrived in a predetermined order in each subfield; and a data line driving circuit that supplies data to the pixel that intersects the scanning line selected by the scanning line driving circuit via the corresponding data line, the data indicating that the pixel is turned on or off.

3. An electro-optical device, wherein a pixel includes a switching element arranged corresponding to each intersection between a plurality of scanning lines and a plurality of data lines, and a pixel electrode connected to the switching element, the pixel being turned on or off by the subfield, the subfield being a unit obtained by dividing one field into subfields, according to weighting of gray scale data indicating a gray scale level of the pixel, and a reference time of weighting for the gray scale data is shifted every scanning line and every subfield, and a plurality of scanning lines being placed into a plurality of blocks, each of blocks being selected in a predetermined order in each subfield, and the scanning line in which the reference time of weighting has arrived being selected in a predetermined order in a selected block, and selection of one particular scanning line in the subfield and selection of a scanning line adjacent thereto in the next subfield being performed in an identically numbered horizontal scan period, the electro-optical device comprising:

a scanning line driving circuit that selects the scanning line in which a reference time of weighting has arrived in a predetermined order in each subfield; and a data line driving circuit that supplies data to the pixel that intersects the scanning line selected by the scanning line driving circuit via the corresponding data line, the data indicating that the pixel is turned on or off.

4. The electro-optical device according to claim 3, further comprising the pixel causing the pixel electrode and a counter electrode to face each other with an electro-optical material interposed therebetween, and causing a voltage level applied to the counter electrode to be inverted at intervals of a predetermined period, and causing a voltage of data indicating that the pixel is turned on or off to be inverted according to an inversion with reference to the voltage level applied to the counter electrode.

5. The electro-optical device according to claim 3, further comprising a voltage level applied to the counter electrode being constant, a voltage of data indicating that the pixel is turned on or off being inverted at intervals of a predetermined period with reference to the voltage level applied to the counter electrode.

6. An electronic apparatus, comprising the electro-optical device according to claim 3, the electronic apparatus being usable as at least one of a projector, a mobile personal computer, a cellular telephone, a liquid crystal television set, a video tape recorder, a car navigation apparatus, a pager, an electronic organizer, a calculator, a word processor, a workstation, a TV telephone, a POS terminal and an apparatus with a touch panel.

* * * * *